US006522855B1

(12) United States Patent
Katoh et al.

(10) Patent No.: US 6,522,855 B1
(45) **Date of Patent: *Feb. 18, 2003**

(54) IMAGE FORMING APPARATUS AND DEVELOPING APPARATUS PREVENTING UNEVEN IMAGE DENSITY

(75) Inventors: Shunji Katoh, Sagamihara (JP); Hideo Yoshizawa, Urawa (JP); Shinji Tamaki, Tokyo (JP); Junichi Terai, Yokohama (JP); Kiyonori Tsuda, Yokohama (JP); Tsuyoshi Imamura, Sagamihara (JP); Masayuki Yamane, Yokohama (JP); Kazuhisa Sudo, Kawasaki (JP); Shinichi Kawahara, Tokyo (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/565,539

(22) Filed: May 5, 2000

(30) Foreign Application Priority Data

| | | |
|---|---|---|
| May 6, 1999 | (JP) | 11-125601 |
| May 6, 1999 | (JP) | 11-126007 |
| Jul. 16, 1999 | (JP) | 11-203408 |
| Mar. 15, 2000 | (JP) | 2000-072309 |

(51) Int. Cl.[7] ..... G03G 15/08
(52) U.S. Cl. ..... 399/274; 399/284
(58) Field of Search ..... 399/274, 284

(56) References Cited

U.S. PATENT DOCUMENTS 4,987,449 A 1/1991 Katoh
5,227,847 A 7/1993 Motohashi et al.

(List continued on next page.)

FOREIGN PATENT DOCUMENTS

| | | |
|---|---|---|
| JP | 63004282 | 1/1988 |
| JP | 08202157 | 8/1996 |
| JP | 08314277 | 11/1996 |
| JP | 09197833 | 7/1997 |
| JP | 10039638 | 2/1998 |
| JP | 10149015 | 6/1998 |

*Primary Examiner*—Quana M. Grainger
(74) *Attorney, Agent, or Firm*—Oblon, Spivak, McClelland, Maier & Neustadt, P.C.

(57) ABSTRACT

A developing apparatus for use in an image forming apparatus includes a developer bearing member having a magnetic field generating device internally and configured to bear and convey two-component developer including toner and magnetic carrier, a first regulating member configured to regulate an amount of the developer born and conveyed by the developer bearing member, a developer container section for storing the developer scraped off by the first regulating member, a second regulating member arranged upstream of the first regulating member in a conveying direction of the developer on the developer bearing member, and a toner container section for supplying toner to the developer bearing member. The developing apparatus changes a toner take-in condition of the developer on the developer bearing member by changing a contact condition between the developer and the toner according to a change of a toner density of the developer on the developer bearing member. A surface of the second regulating member facing the developer bearing member has an area large enough to unify a layer thickness of the developer on the image bearing member in the axial direction of the developer bearing member.

38 Claims, 11 Drawing Sheets

U.S. PATENT DOCUMENTS 5,244,741 A 9/1993 Nagano et al.
5,512,708 A 4/1996 Takahashi et al.
5,659,860 A 8/1997 Sasaki et al.
5,758,241 A * 5/1998 Oyama et al. ..... 399/272
5,765,079 A 6/1998 Yoshiki et al.
5,771,426 A 6/1998 Oka et al.
5,794,108 A 8/1998 Yoshizawa et al.
5,805,965 A 9/1998 Tsuda et al.
5,822,664 A 10/1998 Oka et al.
5,864,733 A 1/1999 Mae et al.
5,909,609 A 6/1999 Yahata et al.
5,915,155 A 6/1999 Shoji et al.
5,970,290 A 10/1999 Yoshiki et al.
5,970,294 A 10/1999 Narita et al.
6,198,895 B1 3/2001 Tsuda et al.

* cited by examiner

IMAGE FORMING APPARATUS AND DEVELOPING APPARATUS PREVENTING UNEVEN IMAGE DENSITY

BACKGROUND OF THE INVENTION

1. Field of the Invention

The present invention relates to an image forming apparatus such as a copying machine, a facsimile, and a printer and to a developing apparatus for a use in these apparatuses.

2. Discussion of the Background

Conventionally, as a developing apparatus for developing with two-component developer including toner and carrier, there is known a developing apparatus in which toner is taken into developer according to behaviors of the developer without a need for a toner density detecting device.

In such a developing apparatus, however, a toner feeding amount depends upon whether or not a behavior of the developer is active and whether or not the developer is abundant in respective places, thereby partially causing the toner density to be unstable, which easily results in fogging or an uneven image density.

Accordingly, in Japanese Patent Application No. 63-4282, for example, to prevent fogging or an uneven density on an image as described above, there is proposed a developing apparatus having two toner supplying regulating members as described below. A first toner supplying regulating member has a fixed end above a doctor blade, which is a developer regulating member for regulating a developer layer thickness on a developer bearing member. The first toner supplying regulating member extends toward a toner supplying tank which is a toner container section. A second toner supplying regulating member is arranged closer to the toner supplying tank than the first toner supplying regulating member. The second toner supplying regulating member extends from the upper portion of the developing apparatus downward, partitioning the developing apparatus into a developer container and a toner supplying tank. The lower free end of the second toner supplying regulating member is on an extension line of a free end of the first toner supplying regulating member or in the developer bearing member side.

In the above developing apparatus, a portion of the uppermost developer layer on the developer bearing member, where developer is relatively coarse and thereby toner is easily taken into, moves to a regulating position of the above doctor blade in a condition of a higher toner density than that of the developer layer on the developing bearing member in the vicinity of the surface of the developer bearing member. Such a movement of the portion of the uppermost developer layer on the developing bearing member, however, is prevented at the free end of the second toner supplying regulating member before the developer layer enters into the developer layer thickness regulating area enclosed by the first toner supplying regulating member, the developer bearing member surface, and the doctor blade. This prevents developer of an extremely high toner density from being supplied to the developer layer thickness regulating area, and only toner sufficiently charged by a friction with magnetic particles is conveyed to the developing area opposite to the image bearing member, such that a fogged strip (background soiling) on an image and an uneven image density in a direction perpendicular to a developer conveying direction with the developer bearing member or the like are prevented.

A developing apparatus previously proposed by the applicant of the present invention and disclosed in Japanese Patent Laid-open Publication No. 9-197833 is useful for dissolving the above-described disadvantages while achieving down-sizing and a lower cost of the apparatus.

The developing apparatus in Japanese Patent Laid-open Publication No. 9-197833 internally has a magnetic field generating device, a developer bearing member for bearing and conveying two-component developer including toner and magnetic carrier, a first regulating member for regulating an amount of developer born and conveyed by the developer bearing member, a developer container section for containing developer scraped off by the first regulating member, and a toner container section arranged adjacent to the developer container section for supplying toner to the developer bearing member. The developing apparatus changes a toner take-in condition of the developer on the developer bearing member by changing a contact condition between the developer and the toner according to a change of the toner density of the developer on the developer bearing member. The developer container section has a second regulating member arranged upstream of the first regulating member in the conveying direction of the developer on the developer bearing member, and the second regulating member is spaced from the developer bearing member so as to regulate a passage of an increase of the developer when the developer layer thickness is increased due to a rise of the toner density of the developer on the developer bearing member. According to this developing apparatus, the toner and the magnetic carrier in the developer are agitated by a cyclic motion of the developer in the developer container section so as to prevent a charged amount of the toner from being reduced, thereby avoiding an occurrence of an abnormal image such as an image having an uneven image density or fogging while achieving down-sizing and a lower cost of the apparatus by reducing the number of components.

FIG. 1 illustrates an example of a developing apparatus related to the above Japanese Patent Laid-open Publication No. 9-197833, and FIG. 2 is an enlarged view of a main portion of the developing apparatus for assistance in explaining behaviors of the developer in the developing apparatus. The developing apparatus includes a developing sleeve 1 as a developer bearing member containing a permanent magnet as a magnetic field generating device, a first regulating member 2 for regulating a layer thickness of developer 22, a developer containing case 4 as a developer containing member for forming a developer container section 3 for containing developer which is obstructed by the first regulating member 2 upstream of the first regulating member 2 in a rotary direction of the developer bearing member, and a toner hopper 6 arranged adjacent to the developer containing case 4 for containing toner. The toner hopper 6 is in communication with the developer container section 3 through a toner supplying path 7 as a toner supplying aperture. Inside the toner hopper 6, there is provided an agitator 8 as a toner agitating member for conveying stored toner 5 to the toner supplying path 7 while agitating the toner 5. Furthermore, at the lower end of the developer containing case 4, there is provided a second regulating member 9 spaced from the developing sleeve 1 so as to regulate a passage of an increase of the developer 22 when a layer thickness of the developer 22 is increased due to a rise of the toner density of the developer 22 on the developing sleeve 1.

In the developing apparatus illustrated in FIGS. 1 and 2, when a toner density of the developer 22 passing the first regulating member 2 is within a predetermined appropriate range, the developer 22 scraped off by the second regulating member 9 forms a developer stagnated portion 10. Then, the developer stagnated portion 10 clogs the toner supplying path 7, and taking-in of toner 5 from the toner hopper 6 into the developer containing section 3 is stopped in this condition. In the developer stagnated portion 10, the developer 22 scraped off by the second regulating member 9 is received by a toner supplying stage 14*b*, which is provided integrally with a developing apparatus frame 14. The toner supplying stage 14*b* is inclined downward to the developing sleeve 1 and has a predetermined length, thereby the developer 22 is prevented from dropping to the toner hopper 6 by a motion of the layer of the developer 22. Accordingly, a constant amount of the developer 22 can always be maintained on the developer sleeve 1 and a self-regulation for constantly supplying toner to the developer 22 is achieved. When a toner density of the developer in the developer container section 3 is decreased by a toner consumption, developer is taken into the developer container portion 3 from the developer stagnated portion 10. Then, a volume of the developer forming the developer stagnated portion 10 is decreased, by which the toner 5 is started to be taken-in again into the developer 22 and is continued to be taken-in until the toner density of the developer 22 reaches a predetermined density.

In the developing apparatuses proposed in Japanese Patent Application No. 63-4282 and Japanese Patent Laid-open Publication No. 9-197833, the layer thickness of the developer on the developer bearing member in an axial direction of the developer bearing member is regulated by a blade-like member as the second toner supplying regulating member or the second toner regulating member (hereinafter referred to as "second regulating member"), which is arranged to face the developer bearing member. Because the above second regulating member has just a small facing area to the developer bearing member, if a gap between the second regulating member and the developer bearing member is uneven in the axial direction of the developer bearing member due to a processing precision of the facing surface, it is very likely that a developer layer is formed with an uneven thickness. Further, unevenness of the developer layer thickness leads to an uneven amount of toner taken into the developer, thereby sometimes causing an uneven image density in the axial direction of the developer bearing member.

To solve the above-described problem, it is conceivable to increase a processing precision of the facing surface of the second regulating member, but it leads to an increase of cost of the apparatus.

In the developing apparatus proposed in Japanese Patent Laid-open Publication No. 9-197833, there is a disadvantage of causing an uneven image density due to insufficiently charged toner which locally exists. Referring to FIG. 2, the toner 5 is conveyed to the developer container section 3 passing through a path as indicated by an arrow in the drawing when the toner density of the developer 22 is lower than the appropriate range. The toner 5 is charged to some extent by friction with the developer 22 when passing a contact interface between the developer stagnated portion 10 and a developer layer on the developing sleeve 1. At this time, the charged amount for the toner 5 is almost proportional to a magnitude of a frictional force between the developer stagnated portion 10 and the developer layer on the developing sleeve 1. Therefore, to achieve a sufficient charged amount for the toner 5, this frictional force needs to be enough. The magnitude of the frictional force is proportional to a conveying force of the developer 22, in other words, to a magnitude of a normal component of a magnetic force applied to the developer 22 by the magnetic field generating device inside the developing sleeve 1.

The frictional force caused by the magnetic force is not enough to charge all of the toner 5 taken into the developer 22 by a sufficient amount, and therefore there locally remains insufficiently charged toner 5. Accordingly, if the insufficiently charged toner 5 flows into the developer container section 3 and is conveyed to the developing area, an inferior image having, for example an uneven density, is generated due to partially different consumed toner amounts when printing an image requiring a large amount of toner, such as a halftone image.

Further, in the above developing apparatus, toner is sometimes directly put in contact with developer being conveyed by the developer bearing member. If the toner is directly put in contact with the developer and thereby the developer having a relatively high toner density enters the developer container section, the toner density of the developer cannot be sufficiently made uniform only by a cyclic motion in the developer container section. Accordingly, an uneven toner density may occur, thereby causing an uneven image density.

Therefore, in Japanese Patent Application No. 10-50185, the applicant of the present invention proposed to further include a developer circulation forming device for forming a developer circulating portion where developer which has been obstructed by the second regulating member is circulated upstream of the second regulating member in the developer conveying direction, and a developer stagnated portion forming device for forming a developer stagnated portion where developer stands still, when the developer toner density is within a predetermined appropriate range, in a toner supplying path connecting the above toner container section with the developer circulating portion.

In this Japanese Patent Application, there is disclosed a developing apparatus illustrated in FIG. 3 as an embodiment of the invention. The developing apparatus illustrated in FIG. 3 is characterized by having constructions described below in addition to the construction of the prior application illustrated in FIG. 1. That is, a toner supplying path 7 is configured to form a developer stagnated portion 10 with a portion of a developer containing case 4 where the second regulating member 9 is formed and a partition 12 arranged so as to face the developer containing case 4, so that developer in the toner supplying path 7 is stagnated in the developer stagnated portion 10 when the toner density of the developer is within an appropriate range. In downstream of the developer stagnated portion 10 in the toner supplying path 7, there is formed a developer circulating portion 11 having a size of causing a cyclic motion of developer by the second regulating member 9 and the developing apparatus frame 14, which is formed integrally with the toner hopper 6 so as to enclose a lower portion of the developing sleeve 1.

In the above developing apparatus, there is formed the above-described developer circulating portion upstream of the second regulating member in the developer conveying direction. Further, the apparatus is configured such that, when the toner density of the developer is within a predetermined appropriate range, toner is prevented from being taken into developer at a contact portion between the toner and the developer in the developer stagnated portion where developer stands still. When the toner density of the developer is decreased, the developer stagnated portion disappears by being taken into the developer circulating portion due to a decrease of a volume of the developer. As a result, the developer is put in contact with toner in the developer circulating portion and the toner is mixed with the developer by agitation in the developer circulating portion before the toner is taken into the developer on the developer bearing member.

In this manner, when the toner density of the developer is appropriate, a developer stagnated portion is formed, which then prevents toner from being directly put in contact with the developer conveyed by the developer bearing member. When the toner density of the developer on the developer bearing member is decreased after the toner has been consumed, developer having a high density, in which toner has been previously mixed in the developer circulating portion, is put in contact with the developer carried on the developer bearing member and having a low density, by which the toner is supplied to the developer and relatively even toner replenishment is achieved.

In the developing apparatus illustrated in FIG. 3, however, a developer bridge is sometimes formed between wall surfaces in the toner supplying path 7, in other words, between the developer containing case 4 and the partition 12, by the developer stagnated in the developer stagnated portion 10 in the toner supplying path 7. By this bridge of the stagnant developer, supplying of toner from the toner hopper 6 is stopped and a space is formed in a lower portion of the developer stagnated portion 10, even when a volume of developer is decreased in the lower portion of the developer stagnated portion 10. Therefore, there is a possibility of causing the toner density to be unstable.

Accordingly, in the above Japanese Patent Application, there is also proposed a developing apparatus in which at least one wall surface forming the developer stagnated portion in the toner supplying path includes a moving member which is moved by an operation of the developing apparatus. This developing apparatus is capable of breaking the bridge of the stagnant developer stagnated between the wall surfaces around the developer stagnated portion in the toner supplying path by a motion of the moving member.

In the developing apparatus proposed in the above Japanese Patent Application, however, sometimes the effect of breaking the bridge of the stagnant developer is not enough. Therefore, it is desirable to achieve a developing apparatus which allows a relatively even toner replenishment without arranging the above partition 12.

It has been found, however, that if the partition 12 is removed from a portion between the toner supplying path 7 and the toner hopper 6 in the developing apparatus illustrated in FIG. 9, there is a possibility that developer in the developer circulating portion 11 overflows into the toner hopper 6 at agitation for mixing the developer in the developer circulating portion 11 with toner in the toner supplying path 7 put in contact with the developer. This overflow occurs when the toner density of the developer is decreased and the developer stagnated portion 10 is taken into the developer circulating portion 11 and thereby the developer circulating portion 11 extends toward the toner hopper 6 in the toner supplying path 7. That is, developer in a portion of the developer circulating portion 11 distant from the developing sleeve 1 diffuses due to a weak binding force of a magnetic force applied by the developing sleeve 1 and thereby overflows into the toner hopper 6 from the toner supplying path 7. If the developer overflows into the toner hopper 6, a magnetic carrier amount of the developer born by the developing sleeve 1 is reduced, by which the toner density fluctuates.

In the developing apparatus illustrated in FIG. 3, when the toner density of developer on the developing sleeve 1 is decreased, the developer in the developer circulating portion 11 is put in contact with the toner 5 in the toner supplying path 7 and the toner 5 is mixed with the developer by agitation in the developer circulating portion 11. The toner 5 thus agitated and mixed with the developer is circulated by a cyclic motion of the developer circulating portion 11 and taken into the developer on the developing sleeve 1 at the contact portion between the developer layer on the developing sleeve 1 and the developer circulating portion 11. If the developer on the developing sleeve 1 has an ear crack portion (a gap between developer ears) at this point, the toner 5 is actively taken into the ear crack portion of the developer. It is assumed that this is because there are a lot of air gaps in the developer having an ear crack portion in comparison with a portion of the developer where the developer is close together and the developer does not have any ear crack portions, and the toner 5 is taken into the air gaps.

In the developing apparatus in FIG. 3, however, an ear crack portion of the developer, which is formed in the toner supplying path 7 by a magnetic pole opposite to the developer circulating portion 11, collides with the developing frame 14, by which the ear crack portion is disturbed. Therefore, the developer born by the developing sleeve 1 by the magnetic pole and in contact with the developer circulating portion 11 cannot form a stable ear crack portion. Accordingly, there is a possibility that the toner cannot be actively taken into the developer, and thereby the toner is not sufficiently taken into the developer in some portions. This unevenness in taking in toner causes an uneven toner density, by which there is a possibility of causing an uneven image density in forming a halftone image.

SUMMARY OF THE INVENTION

The present invention has been made in view of the above-discussed and other problems and addresses the above-discussed and other problems.

Preferred embodiments of the present invention provide a developing apparatus and an image forming apparatus using the developing apparatus, in which toner is taken into developer on a developer bearing member according to a motion of the developer without a need for a toner density detecting device and in which it is possible to prevent an occurrence of an uneven image density by keeping an even toner take-in amount in an axial direction of the developer bearing member.

The preferred embodiments further provide a developing apparatus and an image forming apparatus using the developing apparatus, in which toner is taken into developer on a developer bearing member according to a motion of the developer without a need for a toner density detecting device and in which it is possible to prevent an occurrence of an uneven image density caused by an insufficiently charged toner.

The preferred embodiments further provide a developing apparatus and an image forming apparatus using the same developing apparatus, in which toner is taken into developer on a developer bearing member according to a motion of the developer without a need for a toner density detecting device and in which it is possible to prevent a developer bridge from being formed by stagnant developer and developer from overflowing into a toner container section so as to stabilize a toner density and to achieve a more stable and even image density.

The preferred embodiments further provide a developing apparatus and an image forming apparatus using the same developing apparatus, in which toner is taken into developer on a developer bearing member according to a motion of the developer without a need for a toner density detecting device and in which it is possible to form a stable ear crack portion of developer so as to stabilize a toner density and to achieve a more stable and even image density.

According to a preferred embodiment of the present invention, a developing apparatus includes a developer bearing member having a magnetic field generating device internally and configured to bear and convey two-component developer including toner and magnetic carrier, a first regulating member configured to regulate an amount of the developer born and conveyed by the developer bearing member, a developer container section for storing the developer scraped off by the first regulating member, a second regulating member arranged upstream of the first regulating member in a conveying direction of the developer on the developer bearing member, and a toner container section for supplying toner to the developer bearing member. The developing apparatus changes a toner take-in condition of the developer on the developer bearing member by changing a contact condition between the developer and the toner according to a change of a toner density of the developer on the developer bearing member. A surface of the second regulating member facing the developer bearing member has an area large enough to unify a layer thickness of the developer on the image bearing member in the axial direction of the developer bearing member.

Because of the surface of the second regulating member facing the developer bearing member having an area large enough to unify the layer thickness of the developer in the axial direction of the developer bearing member, even if a gap between the second regulating member and the developer bearing member is uneven in the axial direction of the developer bearing member due to a processing precision of the facing surface, the unevenness of the layer thickness is eliminated by superimposition during a passage of the developer through the facing surface of the second regulating member and thereby an averaged layer thickness of the developer is achieved. The averaged layer thickness of the developer makes it possible to achieve an even toner take-in amount in the axial direction of the developer bearing member, thereby preventing an occurrence of an uneven image density.

According to another preferred embodiment of the present invention, in the above developing apparatus, the developer container section is formed downstream of the second regulating member in the developer conveying direction, and the facing surface of the second regulating member is extended toward an upstream in the developer conveying direction on the developer bearing member.

In the immediately above developing device, because the developer container section is formed upstream of the second regulating member in the developer conveying direction, if the facing surface of the second regulating member is extended toward a downstream of the developer conveying direction, the capacity of the developer container section is reduced, thereby reducing the capacity to store the developer and as a result decreasing a developer life disadvantageously. Accordingly, the facing surface of the second regulating member is extended toward an upstream of the developer conveying direction, and thereby it is possible to have a greater volume of the developer container section and to elongate the developer life correspondingly in comparison with a case in which the second regulating member is extended downstream.

According to another preferred embodiment of the present invention, in the above developing device, a deviation of a magnetic force of the developer bearing member may be set within a range of giving no effect on the layer thickness of the developer passing through the second regulating member. Thereby, it is possible to prevent unevenness in taking toner into the developer caused by a deviation of the magnetic force of the developer bearing member in the axial direction of the developer bearing member.

According to still another preferred embodiment of the present invention, a developing apparatus includes a developer bearing member having a magnetic field generating device internally and configured to bear and convey two-component developer including toner and magnetic carrier, a first regulating member configured to regulate an amount of the developer born and conveyed by the developer bearing member, a developer container section for containing the developer scraped off by the first regulating member, a second regulating member arranged upstream of the first regulating member in a conveying direction of the developer on the developer bearing member, and a toner container section for supplying toner to the developer bearing member. The developing apparatus changes a toner take-in condition of the developer on the developer bearing member by changing a contact condition between the developer and the toner according to a change of a toner density of the developer on the developer bearing member. The second regulating member is spaced from the developer bearing member so as to regulate an increase of a layer thickness of the developer on the developer bearing member when the layer thickness thereof is increased due to a rise of the toner density of the developer. A surface of the second regulating member facing the developer bearing member is spaced from the surface of the developer bearing member such that a gap between an end portion of the facing surface of the second regulating member upstream in the developer conveying direction and the surface of the developer bearing member is larger than that between the downstream end portion of the facing surface of the second regulating member and the surface of the developer bearing member.

In the immediately above developing apparatus, the developer layer including the toner born by the developer bearing member is regulated by the second regulating member and the regulated developer forms a developer stagnated portion. The developer of the developer stagnated portion corresponding to the portion regulated by the facing surface of the second regulating member receives a reaction, which is a force acting in a direction against a conveyance of the developer applied, from the facing surface of the second regulating member. In addition, because the gap between the upstream end portion in the developer conveying direction of the facing surface of the second regulating member and the surface of the developer bearing member is larger than that between its downstream end portion and the surface of the developer bearing member, a component force in the same direction as for the normal component of a magnetic force generated by the magnetic field generating device is generated in the reaction from the facing surface. In other words, the developer in the developer stagnated portion corresponding to the portion regulated by the facing surface of the second regulating member receives the component force of the reaction applied by the facing surface of the second regulating member in addition to the magnetic force. This increases a frictional force on a contact interface between the developer stagnated portion and the developer layer born on the developer bearing member. Therefore, the toner in the developer is sufficiently charged, and thereby it is possible to prevent an occurrence of an uneven image density caused by insufficiently charged toner.

As a method of increasing a frictional force on the contact interface between the developer stagnated portion and the developer layer born on the developer bearing member, it is conceivable to increase the normal component of the magnetic force generated by the magnetic field generating device. However, increasing the normal component of the magnetic force may cause a self-regulating mechanism to not function appropriately for supplying toner in the developing apparatus.

More specifically, the developer stagnated portion formed by the developer regulated by the second regulating member becomes thicker as an increase of the developer passed through the first regulating member is regulated by the second regulating member. As the developer stagnated portion becomes thicker, the upper portion of the developer stagnated portion becomes further distant from the developer bearing member, and thereby it becomes hard for the developer to receive a conveying force of the developer bearing member. The developer finally reaches a saturated layer thickness where it is impossible to further increase the thickness. This saturated layer thickness is approximately proportional to a conveying force of the developer bearing member, in other words, the normal component of the magnetic force received by the developer. Therefore, the saturated layer thickness is increased as the normal component becomes greater.

In the above developing apparatus, however, an amount of supplied toner is automatically regulated at a constant level according to an increase and a decrease of a volume of the developer stagnated portion as described above, and therefore if the volume of the developer stagnated portion, i.e., the saturated layer thickness of the developer stagnated portion, is too large, a layer thickness of the developer stagnated portion fluctuates in a wide range. Such a wide range of the layer thickness fluctuation leads to an uneven toner take-in amount in the axial direction of the developer bearing member, thereby causing a toner density control to be harder or deteriorating a property of the developer stagnated portion to respond to supplying of toner. Thus, if the normal component of the above magnetic force is increased, the self-regulating mechanism for supplying toner may not function appropriately, resulting in an occurrence of a poor image.

Therefore, according to another preferred embodiment of the present invention, in the above developing apparatus, the normal component of the magnetic force, which is applied to the developer by the developer bearing member at the downstream end portion in the developer conveying direction on the surface of the second regulating member facing the developer bearing member, is set to be stronger than the normal component of the magnetic force applied to the developer by the developer bearing member at an upstream portion of the facing surface of the second regulating member in the developer conveying direction.

Accordingly, in the immediately above developing apparatus, because a force of the developer bearing member bearing and conveying developer is proportional to the normal component of the magnetic force applied to developer by the developer bearing member, the developer conveying force of the developer bearing member in the upstream becomes smaller than that in the downstream in the developer conveying direction, and thereby the saturated layer thickness of the developer stagnated portion formed in the upstream is decreased. Therefore, in the developer stagnated portion formed in the upstream, the layer thickness fluctuation becomes more sensitive to supplying of toner and the self-regulating mechanism for supplying toner functions appropriately, while in the downstream, the normal component of the magnetic force is set stronger than that in the upstream so as to achieve a sufficient frictional force on the contact interface between the developer stagnated portion and the developer layer born by the developer bearing member, thereby reliably preventing an insufficiently charged toner.

In the immediately above developing device, regarding the surface of the second regulating member facing the developer bearing member, if a gap between the end-most portion of the facing surface of the second regulating member upstream in the developer conveying direction and the developer bearing member is smaller than the layer thickness of the developer on the developer bearing member, the developer on the developer bearing member is also regulated by a substrate portion of the second regulating member. The developer regulated by the substrate portion of the second regulating member does not receive the component force of the reaction applied by the facing surface of the second regulating member as described above, and therefore the developer stagnated portion is easily diffused and there is a possibility that the developer overflows into the toner container section.

Accordingly, according to still another preferred embodiment of the present invention, in the immediately above developing apparatus, regarding the surface of the second regulating member facing the developer bearing member, the gap between the end-most portion of the surface of the second regulating member upstream in the developer conveying direction and the developer bearing member is set to be larger than the layer thickness of the developer on the developer bearing member. Therefore, the developer layer on the developer bearing member can be regulated only by the facing surface of the second regulating member, and accordingly, diffusion of the developer stagnated portion can be suppressed so as to prevent the developer from overflowing into the toner container portion.

According to still another preferred embodiment of the present invention, a developing apparatus includes a developer bearing member having a magnetic field generating device internally and configured to bear and convey two-component developer including toner and magnetic carrier, a first regulating member configured to regulate an amount of the developer born and conveyed by the developer bearing member, a developer container section for containing the developer scraped off by the first regulating member, and a toner container section for supplying toner to the developer bearing member. The developer container section has a second regulating member arranged upstream of the first regulating member in a conveying direction of the developer on the developer bearing member and the second regulating member is spaced from the developer bearing member so as to regulate an increase of a layer thickness of the developer on the developer bearing member when the layer thickness of the developer is increased due to a rise of a toner density of the developer. Further, a developer circulating portion is formed for circulating the developer obstructed by the second regulating member, and also, a developer stagnated portion, where the developer stands still when a toner density of the developer is within a predetermined appropriate range, is formed in a toner supplying path connecting the toner container section with the developer circulating portion, such that a contact condition between the developer and the toner is changed according to a change of the toner density of the developer on the developer bearing member and thereby a condition of taking the toner into the developer is changed. Furthermore, the second regulating member is configured so as to suppress the diffusion of the developer circulating portion.

In the immediately above developing apparatus, the developer obstructed by the second regulating member moves upstream in the developer conveying direction of the second regulating member to form the developer circulating portion where the developer circulates. When the toner density of the developer is within a predetermined appropriate range, a developer stagnated portion where the developer stands still is formed in the toner supplying path connecting the developer circulating portion with the toner container section so as to prevent the toner from being taken into the developer at a contact portion between the toner and the developer. When the toner density of the developer is decreased, the developer in the developer stagnated portion is taken into the developer circulating portion and thereby the developer stagnated portion disappears, by which the developer is put in contact with the toner in the toner supplying path and the developer is mixed with the toner by agitation in the developer circulating portion. In this condition, diffusion of the developer circulating portion is suppressed by the second regulating member, and therefore the developer circulating portion does not extend toward the toner container section in the toner supplying path. Accordingly, the developer in the developer circulating portion does not diffuse and overflow into the toner container section. Thus, in the developing apparatus of the present invention, it is possible to change the contact condition between the developer and the toner according to the toner density of the developer to change the toner take-in condition of the developer without any partition between the toner supplying path and the toner container section, and further possible to prevent the developer in the developer circulating portion from overflowing into the toner container section. Further, unlike the case of arranging a partition, a bridge of developer will not be formed by the stagnated developer on the wall surfaces of the developer stagnated portion in the toner supplying path, and therefore toner replenishment from the toner container section will not be stopped by such a developer bridge. As a result, the toner density can be stabilized.

According to another embodiment of the present invention, in the immediately above developing apparatus, the second regulating member includes a developer layer thickness regulating section, which is spaced from the developer bearing member so as to regulate an increase of a layer thickness of the developer on the developer bearing member when the layer thickness of the developer is increased due to a rise of a toner density of the developer, and a circulating direction regulating section for regulating the motion of the developer so that the developer circulating section does not diffuse toward the toner container section when the developer obstructed by the developer layer thickness regulating section moves toward upstream in the developer conveying direction to form the developer circulating portion. Thus, because the developer circulating section regulates a moving direction of the developer obstructed by the developer layer thickness regulating section of the second regulating member toward upstream in the developer conveying direction so that the developer circulating portion does not diffuse to the toner container section, the developer circulating portion does not extend toward the toner container section and thereby the developer is prevented from overflowing into the toner container section.

Further, according to another embodiment of the present invention, in the immediately above developing apparatus, the circulating direction regulating section of the second regulating member is a surface facing the developer bearing member extending from the developer layer thickness regulating section toward the upstream in the developer conveying direction. When the developer obstructed by the developer layer thickness regulating section of the second regulating member moves toward the upstream of the developer layer thickness regulating section in the developer conveying direction, the developer moves along the surface of the second regulating member facing the developer bearing member extending from the developer layer thickness regulating section toward the upstream in the developer conveying direction. The developer then diffuses to the toner container section and is obstructed. In this manner, the surface of the second regulating member facing the developer bearing member extending from the developer layer thickness regulating section toward the upstream in the developer conveying direction regulates the developer moving direction toward upstream in the developer conveying direction to such a direction that the developer circulating portion does not diffuse to the toner container section.

According to still another embodiment of the present invention, the surface facing the developer bearing member of the second regulating member may be non-magnetic. In the above developing apparatus, if the facing surface of the second regulating member is magnetic, a bridge of developer is formed between the surface of the second regulating member facing the developer bearing member and the developer bearing member. When the toner density is decreased in the developer on the developer bearing member due to a toner consumption, a force of obstructing taking toner into the developer is increased by the bridge of the developer formed between the facing surface of the second regulating member and the developer bearing member, by which it may be caused that a required amount of toner will not be taken into the developer. If the above-described phenomenon is repeated, an abnormal image having, for example, blank areas may occur. Therefore, a non-magnetic material is used for the surface of the second regulating member facing the developer bearing member, thereby preventing a developer bridge from being formed between the facing surface of the second regulating member and the developer bearing member. Thereby, even when the toner density of the developer is decreased, a required amount of toner can be taken into the developer.

According to still another preferred embodiment of the present invention, a developing apparatus includes a developer bearing member having a magnetic field generating device internally and configured to bear and convey two-component developer including toner and magnetic carrier, a first regulating member configured to regulate an amount of the developer born and conveyed by the developer bearing member, a developer container section for containing the developer scraped off by the first regulating member, and a toner container section provided adjacent to the developer container section for supplying toner to the developer bearing member. The developer container section has a second regulating member arranged upstream of the first regulating member in the conveying direction of the developer on the developer bearing member, and the second regulating member is spaced from the developer bearing member so as to regulate an increase of a layer thickness of the developer when the layer thickness of the developer is increased due to a rise of a toner density of the developer. Further, a developer circulating portion is formed for circulating the developer obstructed by the second regulating member, and also, a developer stagnated portion, where the developer stands still when a toner density of the developer is within a predetermined appropriate range, is formed in a toner supplying path connecting the toner container section with the developer circulating portion, such that a contact condition between the developer and the toner is changed according to a change of the toner density of the developer on the developer bearing member and thereby a condition of taking toner into the developer is changed. Furthermore, a developing apparatus frame is configured so as not to disturb an ear crack portion of the developer, which is formed on the developer bearing member by a magnetic pole opposite to the developer circulating portion. Because the developing apparatus frame does not disturb an ear crack portion of the developer which is formed on the developer bearing member by a magnetic pole opposite to the developer circulating portion, the ear crack portion of the developer can stably be in contact with the developer circulating portion. Further, due to such a stable ear crack portion, toner in the developer circulating portion is actively taken into the developer on the developer bearing member. Therefore, the toner density is stabilized and an even image can be obtained even when a halftone image is formed.

BRIEF DESCRIPTION OF THE DRAWINGS

A more complete appreciation of the present invention and many of the attendant advantages thereof will be readily obtained as the same becomes better understood by reference to the following detailed description when considered in connection with the accompany drawings, wherein.

DETAILED DESCRIPTION OF THE PREFERRED EMBODIMENTS

Figure 1:
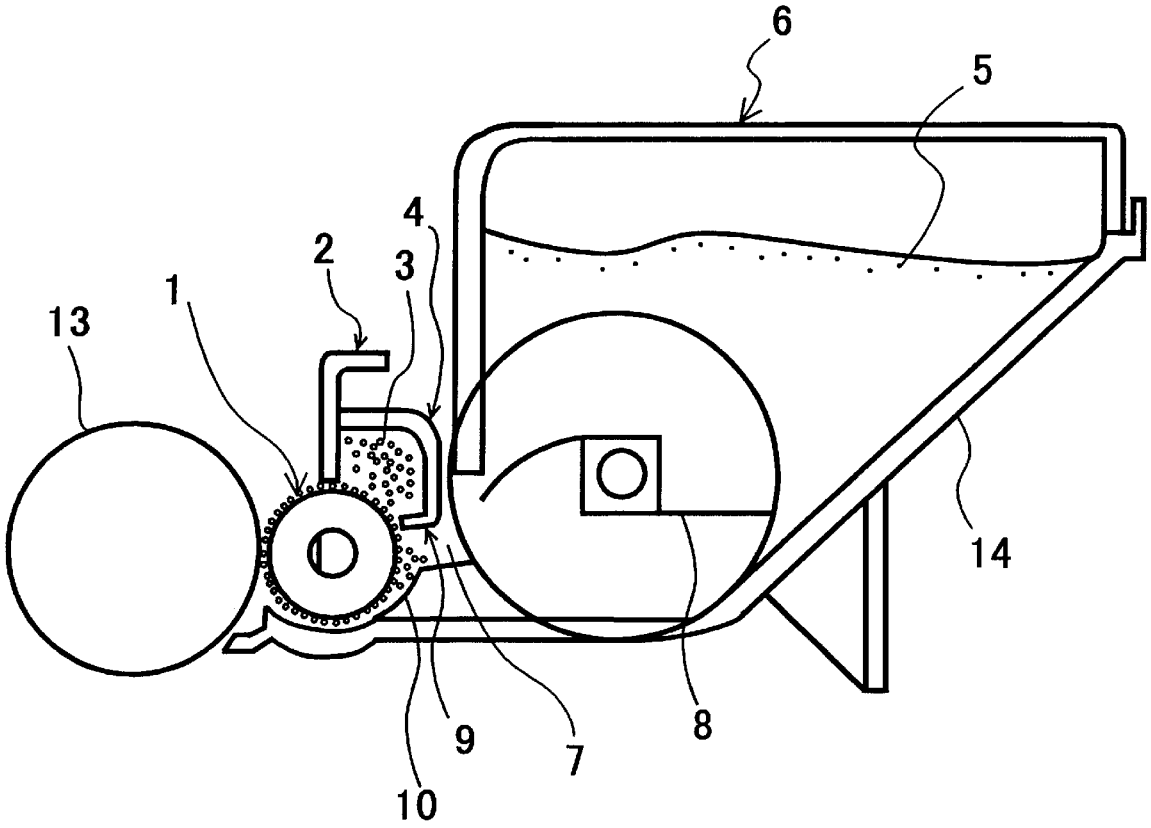
Fig. 1 (PRIOR ART)
FIG. 1 is a schematic drawing illustrating a developing apparatus of prior art.
Figure 2:
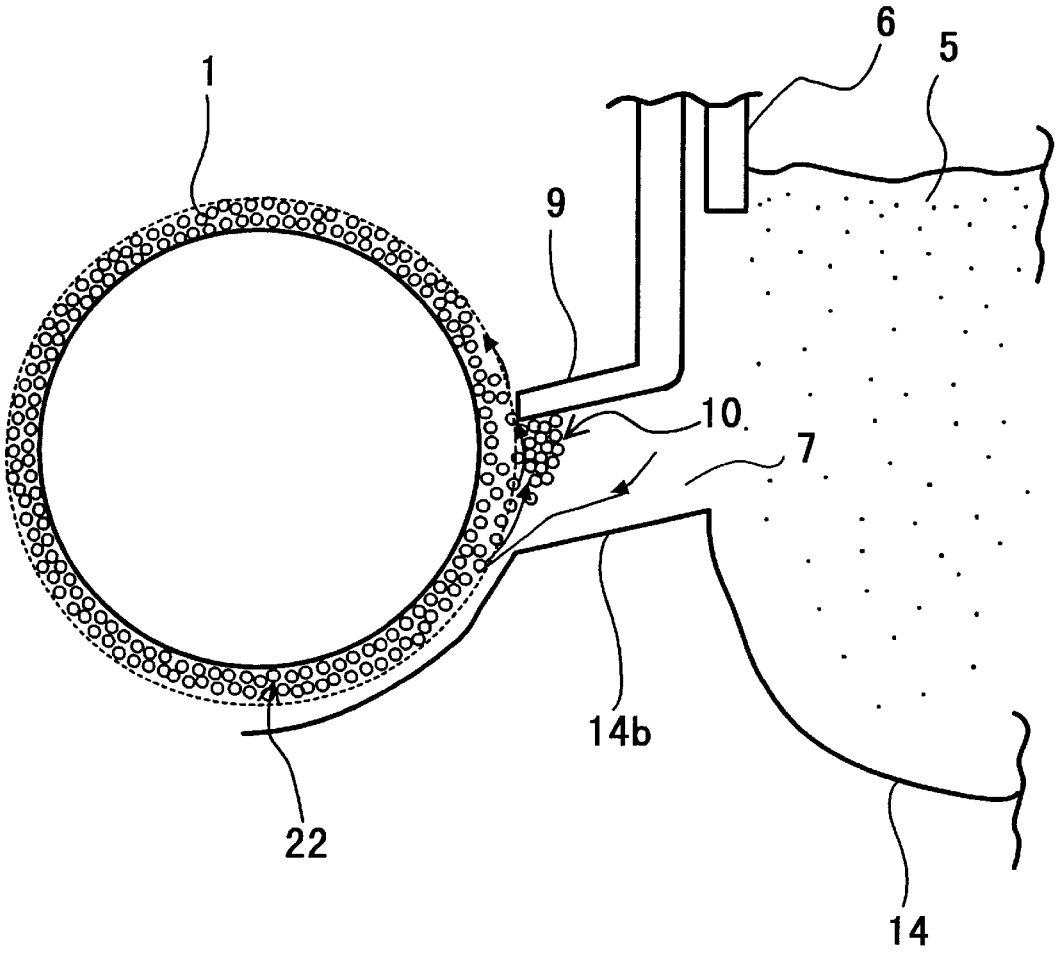
Fig. 2 (PRIOR ART)
FIG. 2 is an enlarged view of a portion of the developing device of FIG. 1 in the vicinity of a second regulating member of the developing apparatus.

Referring now to the drawings, wherein like reference numerals designate identical or corresponding parts throughout the several views, preferred embodiments of the present invention are now described, in which the present invention is applied to a developing apparatus for use in an electrophotographic copying machine as an image forming apparatus.

First Embodiment

Figure 4:
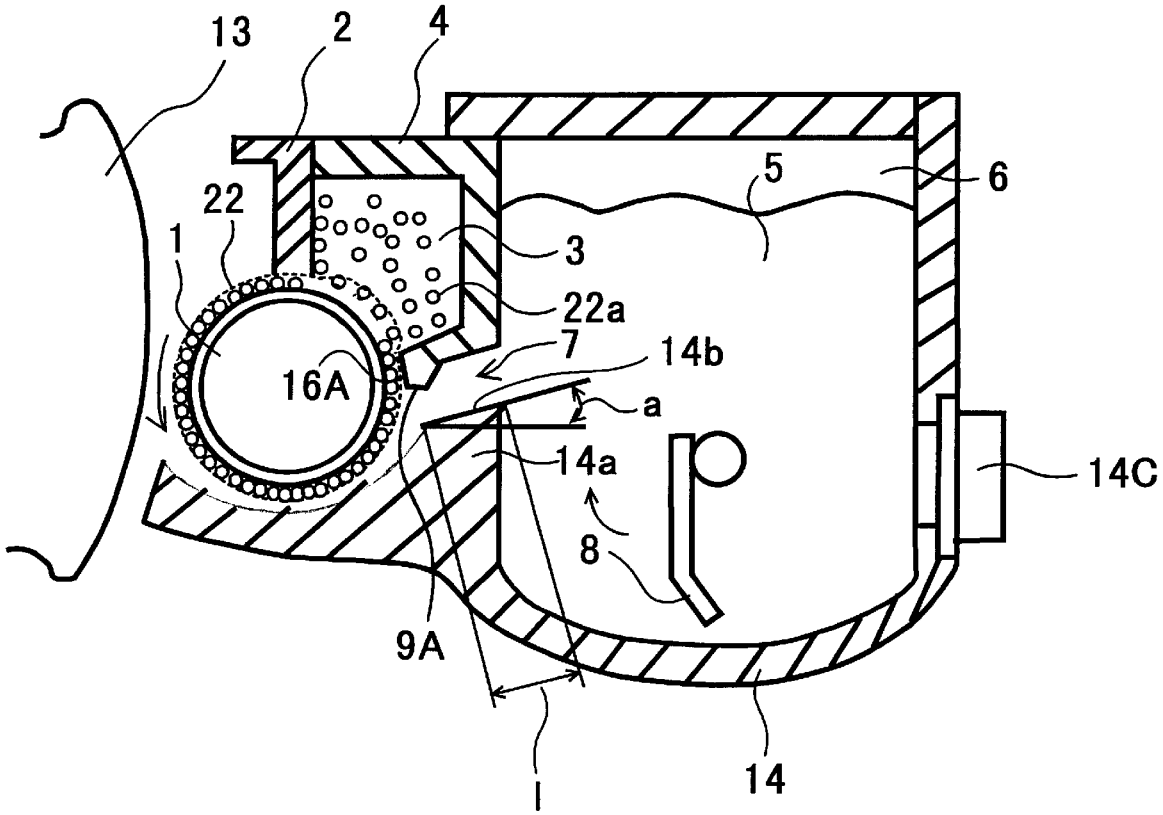
FIG. 4 is a schematic drawing illustrating a configuration of a developing apparatus according to an embodiment of the present invention.

FIG. 4 is a schematic drawing illustrating a configuration of a developing apparatus according to an embodiment of the present invention.

Referring to FIG. 4, the developing apparatus arranged on one side of a photosensitive drum 13 as a latent image bearing member includes a developing sleeve 1 as a developer bearing member, a developer containing case 4, a first regulating member 2, a second regulating member 9A, a toner hopper 6 as a toner container section, a developing apparatus frame 14, and others.

The developing sleeve 1 is driven to rotate in a direction indicated by an arrow in the diagram by a driving device which is not shown. The developing sleeve 1 bears developer 22 including toner and magnetic particles (carrier) on its surface. The developing sleeve 1 is made of non-magnetic material, and has inside a magnet (not shown) as a magnetic field generating device. The magnet is arranged in a relative position unchangeable to the developing apparatus 2.

The first regulating member 2 is arranged spaced from the developing sleeve 1 so as to have a gap between its end portion and an outer circumferential surface of the developing sleeve 1, and is used to regulate a layer thickness of the developer 22. Upstream of the first regulating member 2 in a rotary direction of the developing sleeve 1, there is arranged the developer containing case 4 as a developer containing member forming the developer containing section 3 for containing developer which is obstructed by the first regulating member 2. The developer containing case 4 is integrated with the developing apparatus frame 14. The developer container section 3 is configured so as to have a space large enough to cyclically move the developer 22 within the reach of the magnetic force of the magnet in the developing sleeve 1.

The developer container section 3 is in communication with the toner hopper 6 by a toner supplying path 7 as a toner supplying aperture. The developing apparatus frame 14 has a raised portion 14*a* having an opposing surface 14*b* facing a bottom of the developer containing case 4. A space between the bottom of the developer containing case 4 and the opposing surface 14*b* forms the toner supplying path 7. The developing apparatus frame 14 is integrated with the toner hopper 6 so as to enclose a lower portion of the developing sleeve 1.

In the toner hopper 6, there is arranged an agitator 8 as a toner supplying device, which is rotated by a driving device (not shown) for agitating toner 5 in the toner hopper 6 to deliver it toward the toner supplying path 7. In addition, the toner hopper 6 has a toner end detecting device 14C for detecting lack of the remainder of toner 5 in the toner hopper 6.

Furthermore, at the lower end portion of the developer containing case 4, a second regulating member 9A is formed so as to be in the vicinity of the developing sleeve 1. The second regulating member 9A is spaced from the developing sleeve 1 so as to regulate an increase of developer on the developing sleeve 1 when a layer thickness of the developer is increased due to a rise of a toner density of the developer on the developing sleeve 1. A shape of the second regulating member 9A characterizing the present invention is described in detail later.

In the above configuration, the toner 5 delivered from the inside of the toner hopper 6 by the toner agitator 8 is supplied to the developer 22 born by the developing sleeve 1 passing through the toner supplying path 7 and then carried into the developer container section 3. The developer 22 in the developer container section 3 is born by the developing sleeve 1 and conveyed to a position opposite to a circumferential surface of a photosensitive drum 13, where only the toner 5 is electrostatically coupled to an electrostatic latent image formed on the photosensitive drum 13, by which a toner image is formed on the photosensitive drum 13.

Figure 5:
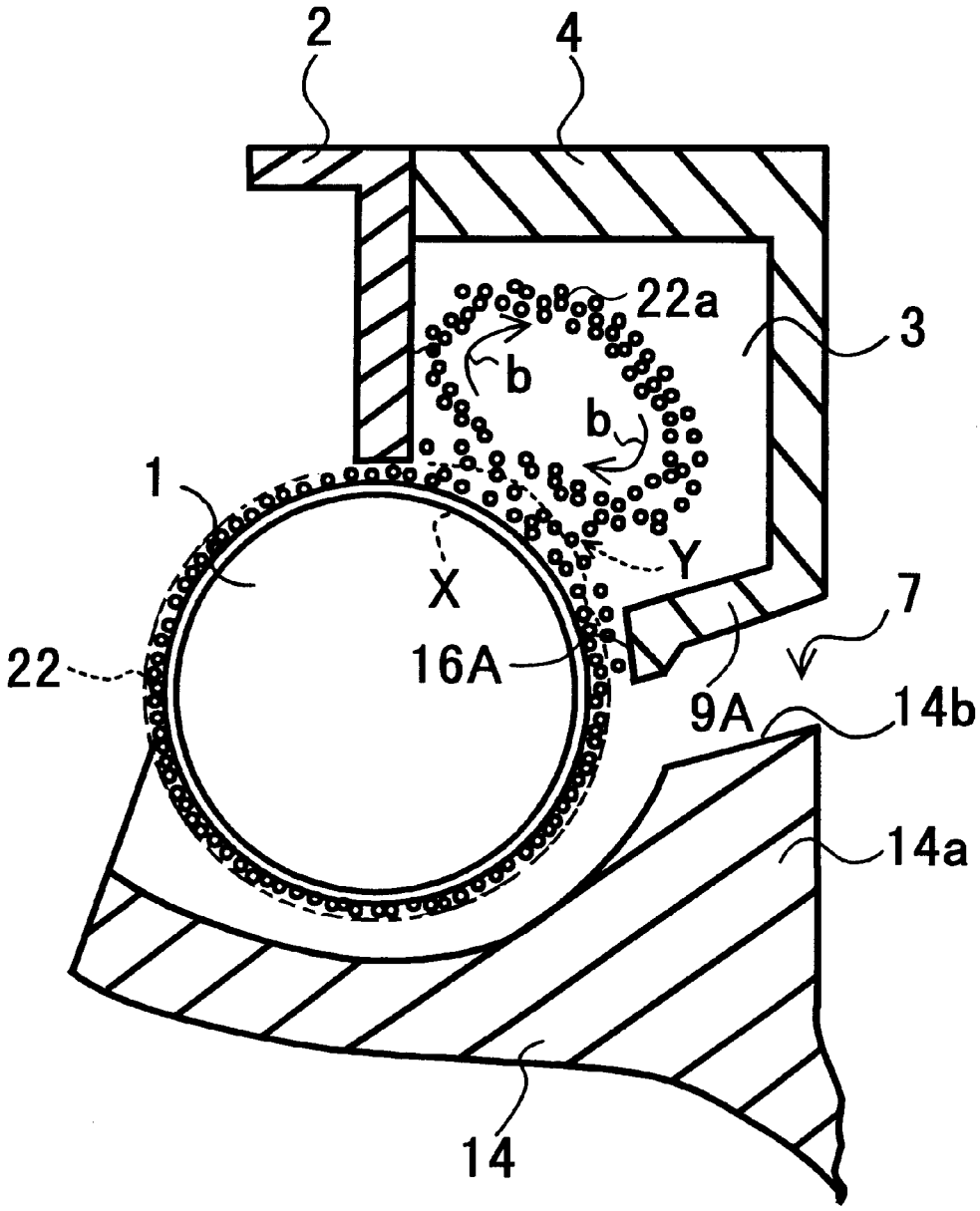
FIG. 5 is a schematic view for explaining a behaviour of a developer in the developing apparatus.
Figure 6:
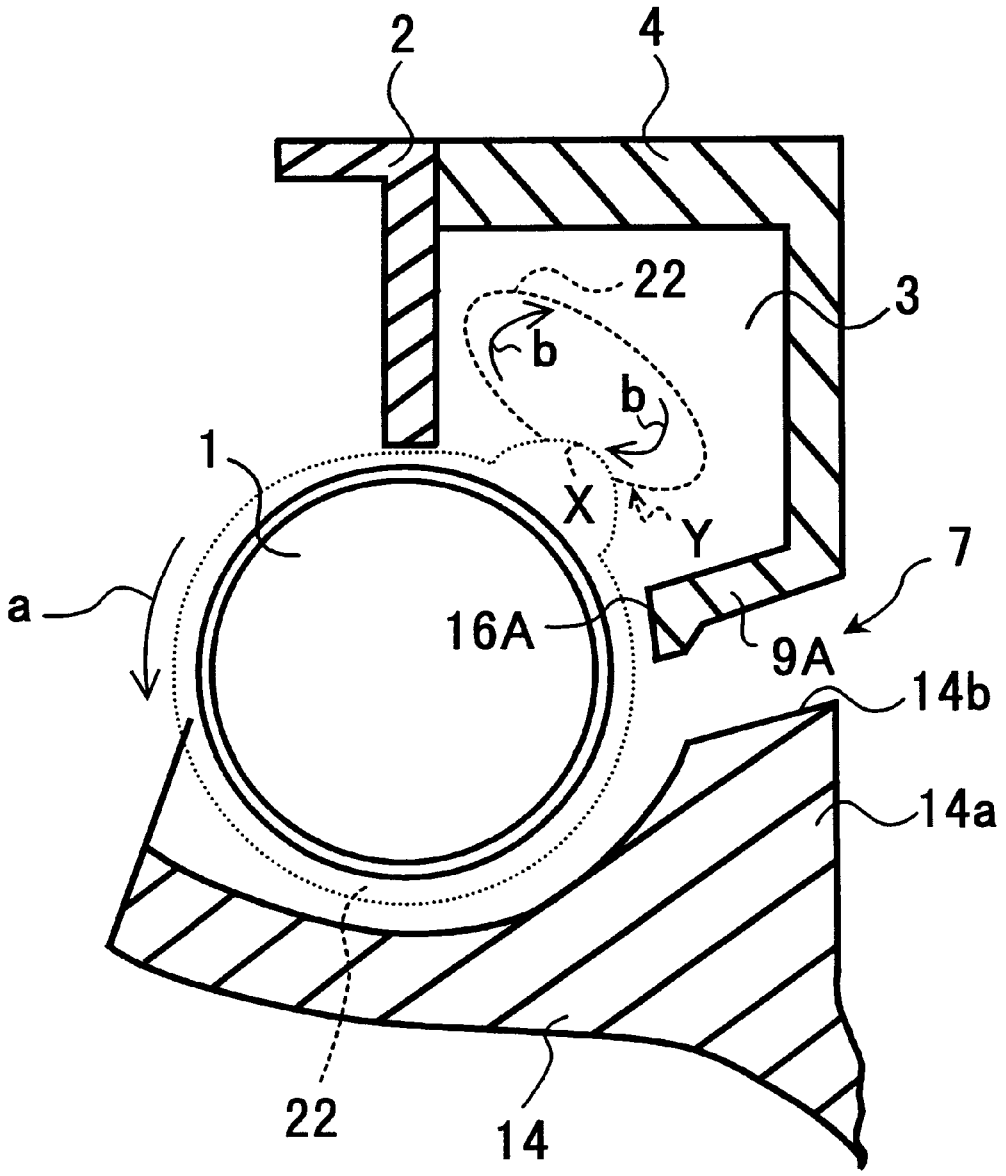
FIG. 6 is another view for explaining a behaviour of the developer in the developing apparatus.
Figure 7:
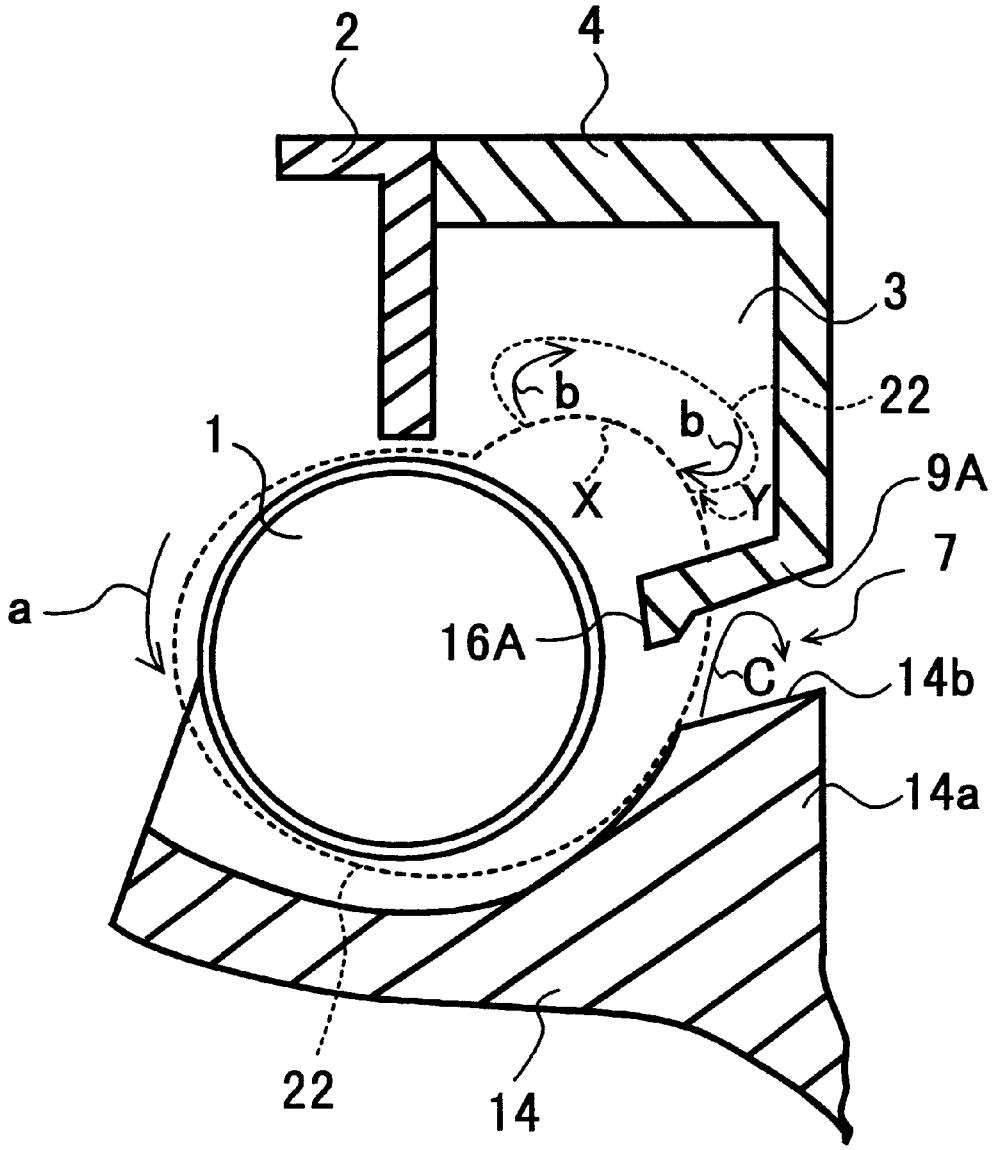
FIG. 7 is another view for explaining a behaviour of the developer in the developing apparatus.

Next, a behavior of the developer 22 at forming the above toner image is described by referring to FIGS. 5, 6, and 7. If start agent including magnetic carrier 22*a* only is set in the developing apparatus, as illustrated in FIG. 5, the magnetic carrier 22*a* is divided into one portion magnetically adhering to a surface of the developing sleeve 1 and the other portion stored in the developer container section 3. The magnetic carrier 22*a* stored in the developer container section 3 cyclically moves at a moving rate of 1 mm/s or greater in a direction indicated by an arrow b by a magnetic force of a magnet inside the developing sleeve 1 with a rotation of the developing sleeve 1 in a direction indicated by an arrow a (FIG. 6). Then, there is formed an interface X in a boundary portion between a surface of the magnetic carrier 22*a* magnetically adhering to the surface of the developing sleeve 1 and a surface of the magnetic carrier 22*a* moving inside the developer container section 3.

Next, when toner 5 is set in the toner hopper 6, the toner 5 is supplied to the magnetic carrier 22*a* born by the developing sleeve 1 through the toner supplying path 7. Therefore, the developing sleeve 1 bears developer 22 which is a mixture of the toner 5 and the magnetic carrier 22*a*.

In the developer container section 3, because of a presence of the stored developer 22, a force is applied to the developer 22 conveyed by the developing sleeve 1 in a direction of stopping the conveyance of the developer 22. In this condition, when the toner 5 on the surface of the developer 22 born by the developing sleeve 1 is conveyed to the interface X, a frictional force among the developer 22 in the vicinity of the interface X is reduced to decrease the conveying force of the developer 22 in the vicinity of the interface X, thereby decreasing a conveyance amount of the developer 22 in the vicinity of the interface X.

On the other hand, the developer 22 upstream of a junction Y in a rotary direction of the developing sleeve 1 is not affected by the force to stop the conveyance thereof like the one applied to the developer 22 conveyed by the developing sleeve 1 in the developer container section 3 described above. Therefore, due to lost balance of a conveyance amount between the developer 22 conveyed to the junction Y and the developer 22 conveyed on the interface X, a multiple collision of the developer 22 is caused, by which the position of the junction Y rises as illustrated in FIG. 6 to increase the layer thickness of the developer 22 including the interface X. In addition, the layer thickness of the developer 22 which has passed the first regulating member 2 increases gradually and the increased developer 22 is scraped off by the second regulating member 9A in a regulating position of the second regulating member 9A.

When the developer 22 which has passed the first regulating member 2 has reached a predetermined toner density, as illustrated in FIG. 7, a laminar increase of the developer 22 which has been scraped off by the second regulating member 9A clogs the toner supplying path 7 and thereby take-in of the toner 5 is completed in this condition. At this point, the volume of the developer 22 is increased due to a rise of the toner density in the developer container section 3, thereby narrowing the space inside the developer container section 3. As a result, a moving rate at which the developer 22 cyclically moves in a direction indicated by the arrow b in this diagram is lowered.

In the layer of the developer 22 formed so as to clog the toner supplying path 7, the developer 22 scraped off by the second regulating member 9A is received by the opposing surface 14*b* after moving as indicated by an arrow c in FIG. 7 at a moving rate of 1 mm/s or greater. Because the opposing surface 14*b* is inclined downward at an angle to the developing sleeve 1 and has a predetermined length, it is possible to prevent the developer 22 from being dropped to the toner hopper 6 by a motion of the layer of the developer 22, such that the constant amount of the developer 22 is always kept and thereby a self-regulation of a constant toner replenishment is achieved at all times.

Next, a description is made for a shape of the second regulating member 9A, which is a characterizing portion of this embodiment.

The surface 16A of the second regulating member 9A facing the developing sleeve 1 is configured to have an area large enough to unify a layer thickness of the developer 22 in an axial direction of the developing sleeve 1. Specifically, the surface 16A of the second regulating member 9A facing the developing sleeve 1 has a surface shape along a circumferential surface of the developing sleeve 1 and extends toward the upstream in the conveying direction of the developer 22 on the developing sleeve 1. In this manner, the facing surface 16A of the second regulating member 9A of this embodiment is configured to have an area larger than the facing surface of the second regulating member having a blade shape according to the prior application as described above.

In the above configuration, when the developer 22 including the toner 5 reaches the second regulating member 9A, the layer thickness of the developer 22 is regulated by the facing surface 16A of the second regulating member 9A. At this time, even if there is an uneven gap between the second regulating member 9A and the developing sleeve 1 in the axial direction of the developing sleeve 1 due to a processing precision of the facing surface 16A, the unevenness of the layer thickness of the developer 22 is eliminated by superimposition while the developer 22 passes the facing surface 16A having a large opposing area and thereby the layer thickness of the developer 22 is averaged in the axial direction of the developing sleeve 1. As the layer thickness of the developer 22 is averaged, the amount of toner 5 taken into the developer 22 is made constant.

As described above, by configuring the facing surface 16A of the second regulating member 9A facing the developing sleeve 1 so as to have an area large enough to unify the layer thickness of the developer 22 in the axial direction of the developing sleeve 1, the amount of toner 5 taken into the developer can be made constant, and thereby an occurrence of an uneven image density is prevented.

In addition, in the developing apparatus illustrated in FIG. 4, the facing surface 16A of the second regulating member 9A is arranged so as to extend toward the upstream in the developer 22 conveying direction. Because the developer container section 3 is formed downstream of the second regulating member 9A in the developer conveying direction, if the facing surface 16A should extend toward the downstream, a capacity of the developer container section 3 is reduced to decrease the developer 22 to be stored, which leads to a reduction of a developer life disadvantageously. In this developing apparatus, however, the facing surface 16A extends toward the upstream in the developer conveying direction, by which the capacity of the developer container section 3 can be enlarged in comparison with a case of the facing surface 16A extending toward the downward, thereby elongating the developer life correspondingly.

It should be noted that, however, a magnetic force distribution is preferably uniform in the axial direction of the developing sleeve 1 so as not to make an uneven layer thickness of the developer 22 passing the facing surface 16A of the second regulating member 9A.

Therefore, in the developing apparatus in FIG. 4, a deviation of the magnetic force of the developing sleeve 1 is set to a value within a range of keeping constant a layer thickness of the developer 22 passing the second regulating member 9A. Specifically, by considering a torsion in the axial direction of the sleeve 1 which may occur in a magnetic technique or in a magnetically adhering process or the like, the deviation of the magnetic force of the developing sleeve 1 in the facing surface 16A is set so as to be within a range of 25%. Accordingly, unevenness of the layer thickness of the developer 22 can be reduced, thereby preventing toner 5 from being taken into the developer 22 inconstantly in the axial direction of the developing sleeve 1.

[Second Embodiment]

Figure 8:
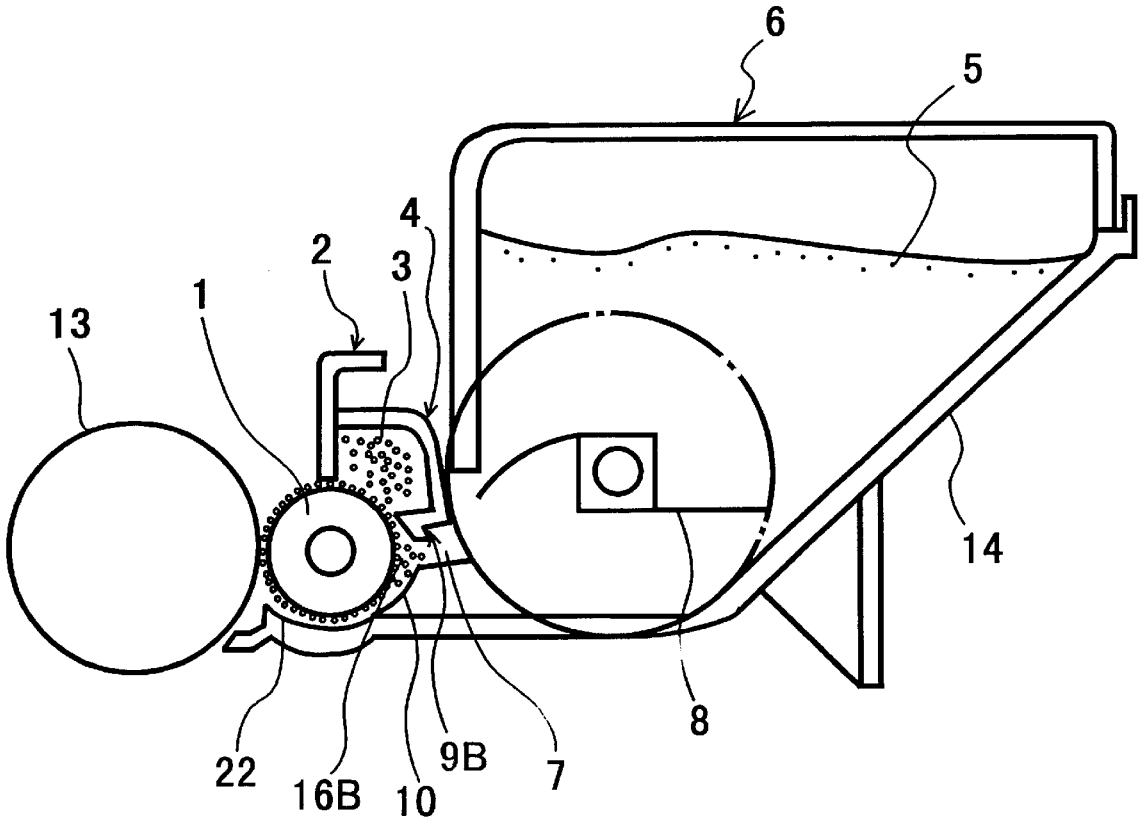
FIG. 8 is a schematic drawing illustrating a configuration of a developing apparatus according to another embodiment of the present invention.

Referring to FIG. 8, there is illustrated a configuration of a developing apparatus according to another embodiment of the present invention.

The basic constitution and operation of the developing apparatus in FIG. 8 are the same as those for the developing apparatus according to the first embodiment, and therefore identical reference characters are used to designate members substantially identical or corresponding to those of the first embodiment, with omitting a description of the identical members and describing only a characterizing portion of this embodiment.

Figure 9:
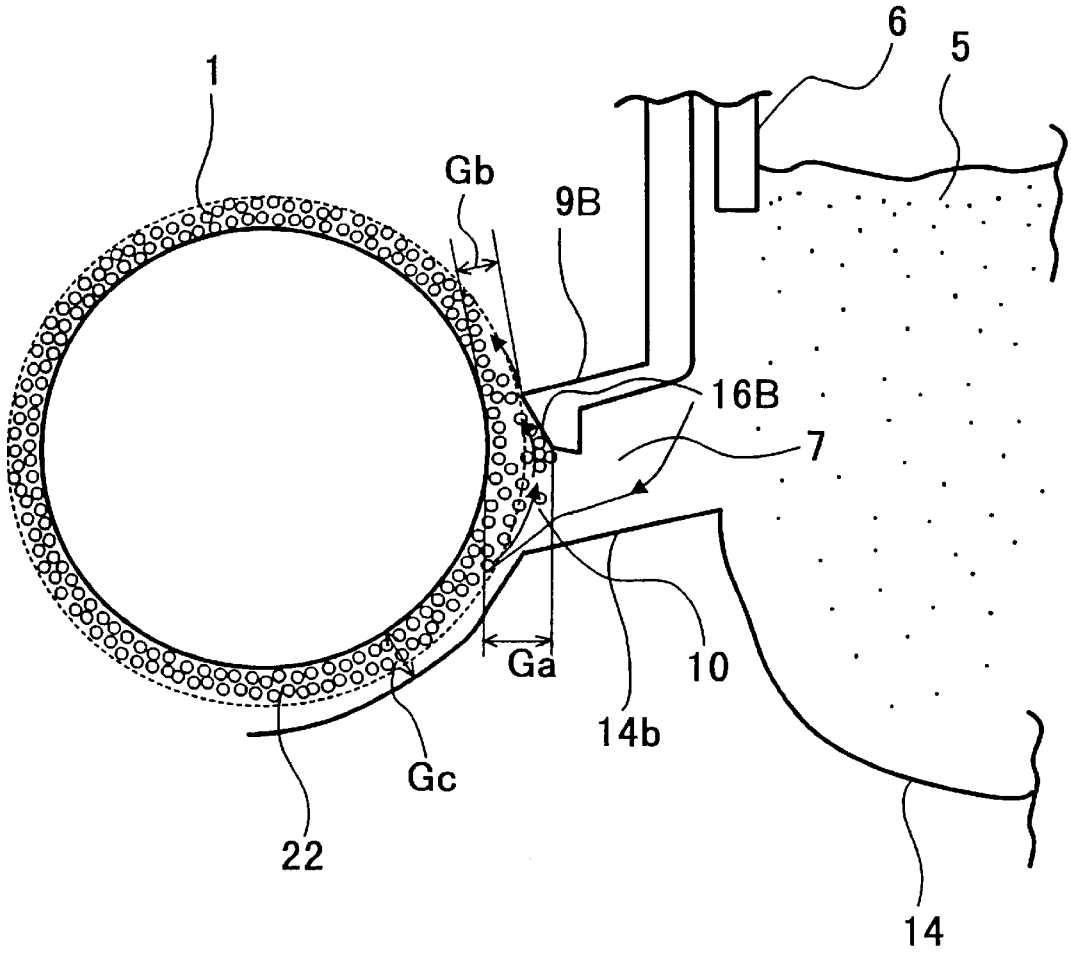
FIG. 9 is an enlarged view of a portion of the developing device of FIG. 5 in the vicinity of a second regulating member of the developing apparatus.

Referring to FIG. 9, there is illustrated an enlarged view of a portion in the vicinity of a second regulating member 9B in the developing apparatus in FIG. 8. In this embodiment, the second regulating member 9B is configured to have a shape effective to have a large frictional force described above so that the toner 5 can be sufficiently charged. Specifically, as illustrated in FIG. 9, regarding a facing surface 16B of the second regulating member 9B facing the developing sleeve 1, a gap Ga between an upstream end portion in a developer conveying direction and a surface of the developing sleeve 1 is wider than a gap Gb between a downstream end portion and a surface of the developing sleeve 1.

In the above configuration, the layer of the developer 22 including toner 5 born by the developing sleeve 1 is regulated by the second regulating member 9B, and a developer stagnated portion 10 is formed by the regulated developer 22. At this time, the developer 22 in a portion of the developer stagnated portion 10, which is regulated by the facing surface 16B, receives a reaction, which is a force acting in a direction of interfering with the conveyance of the developer 22, from the facing surface 16B of the second regulating member 9B. In addition, the facing surface 16B is tapered so that the gap Ga is larger than the Gb, and therefore a component force is generated in the reaction of the facing surface 16B applied to the developer stagnated portion 10, in the same direction as for a normal component of a magnetic force generated by the magnet in the developing sleeve 1. In other words, the developer 22 in the portion of the developer stagnated portion 10, which is regulated by the facing surface 16B, receives the component force of the reaction from the facing surface 16B in addition to the magnetic force. This increases a frictional force on a contact interface between the developer stagnated portion 10 and the layer of the developer 22 born by the developing sleeve 1. Therefore, the toner 5 in the developer 22 is sufficiently charged, and thereby an occurrence of an uneven image density caused by insufficiently charged toner is prevented.

As a method of increasing the frictional force on the contact interface between the developer stagnated portion 10 and the layer of the developer 22 born by the developing sleeve 1, it is conceivable to increase a normal component of a magnetic force generated by a magnet roller inside the developing sleeve 1.

If the normal component of the magnetic force is increased, however, there is a possibility that the self-regulation mechanism of the developing apparatus for supplying toner to developer will not function appropriately. Specifically, the developer stagnated portion 10 formed by the developer 22 regulated by the second regulating member 9B is increased in thickness whenever the increase of the developer 22 passing the first regulating member 2 is regulated by the second regulating member 9B. As the developer stagnated portion 10 is increased in thickness, the upper portion is distant further from the developing sleeve 1 and therefore it becomes harder to receive a conveying force from the developing sleeve 1, and then the developer stagnated portion 10 reaches a saturated layer thickness at which the thickness cannot be increased any more. This saturated layer thickness becomes necessarily larger as the conveying force of the developing sleeve 1 is increased. Because the conveying force of the developing sleeve 1 is almost proportional to the normal component of the magnetic force applied to the developer 22, as the normal component is increased, the saturated layer thickness becomes larger.

A too large volume of the developer stagnated portion 10, i.e., a too large saturated layer thickness of the developer stagnated portion 10, enlarges a range of a fluctuation of the layer thickness of the developer stagnated portion 10. If the range of the fluctuation of the layer thickness is excessively large, there is a possibility that toner 5 will be taken into the developer at an uneven rate in the axial direction of the developing sleeve 1, thereby leading to a difficulty of the toner density control or to a deterioration of a property of the developer stagnated portion 10 to respond to supplying of toner. In this manner, an increased normal component of the magnetic force may cause a malfunction of the self-regulation mechanism for supplying toner, which results in an occurrence of a defective image.

Therefore, in this embodiment, the normal component of the magnetic force, which is applied to the developer 22 by the magnet in the developing sleeve 1 at the downstream end portion of the facing surface 16B of the second regulating member 9B in the developer conveying direction, is set so as to be greater than the normal component of the magnetic force applied to the developer 22 by the magnet in the upstream in the developer conveying direction. Because a force of the developing sleeve 1 for bearing and conveying the developer 22 is proportional to the normal component of the magnetic force applied to the developer 22, the developer conveying force of the developing sleeve 1 in the upstream becomes smaller than that in the downstream. Therefore, the saturated layer thickness of the developer stagnated portion 10 formed in the upstream is smaller than that in the downstream. Accordingly, in the developer stagnated portion 10 formed in the upstream, the layer thickness is more sensitively fluctuated in response to supplying of toner, by which the self-regulation mechanism for supplying toner functions appropriately. On the other hand, the normal component of the magnetic force in the downstream is set greater than that in the upstream so as to achieve a sufficiently large frictional force on the contact interface between the developer stagnated portion 10 and the layer of the developer 22 born by the developing sleeve 1, by which a lack of charging can be prevented more reliably.

To set the normal component of the magnetic force of the magnet in the developing sleeve 1 as described above, it is possible to use a method of, for example, designing the apparatus so as to have a peak of the magnetic pole of the developing sleeve 1 in the vicinity of the downstream end portion of the facing surface 16B in the developer conveying direction.

In addition, it is preferable to set the gap Ga at the end-most portion of the facing surface 16B in the upstream in the developer conveying direction so as to be larger than the layer thickness of the developer 22 on the developing sleeve 1. This is because the gap Ga smaller than the layer thickness of the developer 22 on the developing sleeve 1 forces the developer 22 to be regulated by a substrate portion of the second regulating member 9B as well as by the facing surface 16B of the second regulating member 9B and thereby the developer stagnated portion 10 is easily diffused, because a component force of the reaction from the facing surface 16B is not applied to the developer regulated by the substrate portion as described above, thus causing a possibility that the diffused developer will overflow into the toner hopper 6, Therefore, in this embodiment, the gap Ga is arranged so as to be larger than the layer thickness of the developer on the developing sleeve 1 as illustrated in FIG. 9. Specifically, the magnet is arranged inside the sleeve 1 so as not to expose the peak of the magnetic pole in the normal direction to the toner supplying path 7, and under this condition, a gap Gc between the developing sleeve 1 and the developing apparatus frame 14 and the gap Ga are arranged so as to satisfy a relationship represented by an inequality: $Gc<Ga$. In this configuration, the layer thickness of the developer 22 born by the developing sleeve 1 is not larger than the gap Gc even at its maximum. Therefore, in a condition that the relationship represented by the inequality: $Gc<Ga$ is satisfied, the gap Ga is larger than the layer thickness of the developer 22, and therefore the developer 22 on the developing sleeve 1 can be regulated only by the facing surface 16B. Accordingly, the diffusion of the developer stagnated portion 10 can be suppressed to prevent the developer 22 from overflowing into the toner hopper 6.

[Third Embodiment]

Figure 10:
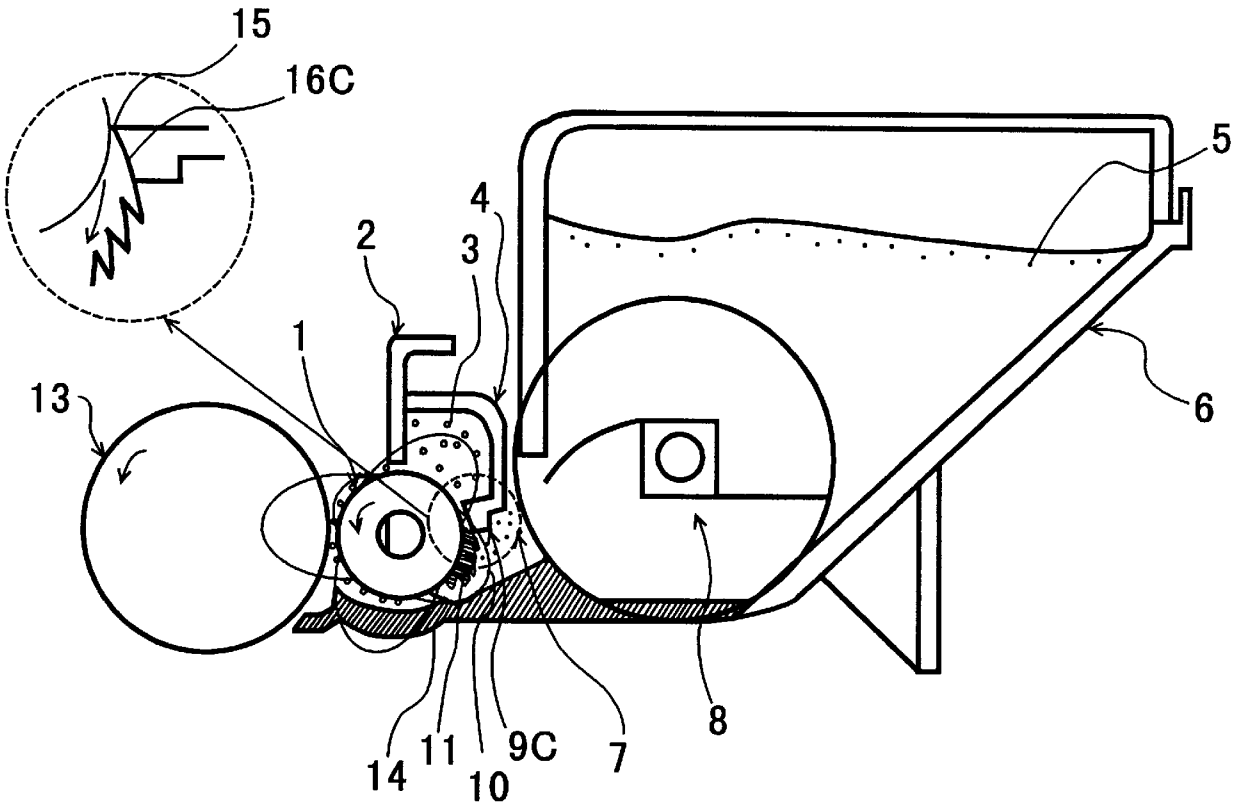
FIG. 10 is a schematic drawing illustrating a configuration of a developing apparatus according to another embodiment of the present invention.

Referring to FIG. 10, there is illustrated a configuration of a developing apparatus according to another embodiment of the present invention.

In the developing apparatus of this embodiment, a toner supplying path 7 is configured so as to form, with the portion of a developer containing case 4 where a second regulating member 9C is formed and the portion of a developing apparatus frame 14 facing the developer containing case 4, a developer stagnated portion 10 where developer is stagnated in the toner supplying path 7 when a toner density of developer (i.e., a percentage by weight of toner in developer) is within an appropriate range. In downstream of the developer stagnated portion 10 in the toner supplying path 7, there is formed a developer circulating portion 11 for causing a cyclic motion in the developer with the second regulating member 9C and the developing apparatus frame 14. In the developing apparatus illustrated in FIG. 10, identical reference characters are used to designate substantially identical or corresponding members to the first embodiment and their description is omitted here.

Because stagnant developer standing in the developer stagnated portion 10 is put in a still condition, at a contact portion between toner 5 in a toner hopper 6 and the stagnant developer, the stagnant developer is never mixed with the toner 5 and therefore the toner 5 is not taken into the stagnant developer there.

In the developer circulating portion 11, at a consumption of toner in the developer in the developer circulating portion 11, the volume of developer is decreased, and thereby the stagnant developer of the developer stagnated portion 10 is taken into the developer circulating portion 11 to be disappeared. Then, when the toner 5 delivered from the toner hopper 6 is put into contact with the developer circulating portion 11, the toner 5 is taken into circulating developer in the developer circulating portion 11, by which a toner density of the developer is increased. When the volume of the developer is increased as a result of taking the toner 5 into the developer, excess developer forms a developer stagnated portion 10 again to prevent the toner 5 from being taken in from the toner hopper 6.

Then, in the developer circulating portion 11, the developer having a high toner density after having been mixed with the toner 5 is put into contact with developer having a low toner density as a result of the toner conveyed by the developing sleeve 1 having been consumed, by which the toner 5 is supplied to the developer from the contact portion and thereby substantially even toner replenishment is achieved.

Next, a description is made for a shape of the second regulating member 9C which is a characterizing portion of this embodiment. In FIG. 10, the facing surface 16C of the second regulating member 9C facing the developing sleeve 1 has a developer layer thickness regulating section 15 spaced from the developing sleeve 1 so as to regulate an increase of developer when a layer thickness of the developer is increased due to a rise of a toner density of the developer on the developing sleeve 1. In addition, the facing surface 16C extends toward the upstream of the developer layer thickness regulating section 15 in the developer conveying direction and is tapered so that a gap to the developing sleeve 1 is gradually narrowed from the upstream toward the downstream in the developer conveying direction.

The developer obstructed by the second regulating member 9C moves toward the upstream of the developer layer thickness regulating section 15 in the developer conveying direction and forms the developer circulating portion 11. At this time, the developer moves along the facing surface 16C extending toward the upstream of the developer layer thickness regulating section 15 in the developer conveying direction. In this manner, the facing surface 16C extending upstream in the developer conveying direction functions as a circulating direction regulating section for regulating the developer moving direction toward the upstream in the developer conveying direction so that the developer circulating portion 11 does not diffuse to the toner hopper 6. Thus, the developer circulating portion 11 is stopped to diffuse to the toner hopper 6, by which the developer circulating portion 11 having a thin and stable shape is formed toward the upstream in the developer conveying direction.

As described above, when the toner density of the developer is decreased in the above condition, stagnant developer in the developer stagnated portion 10 is taken into the developer circulating portion 11 and thereby the developer stagnated portion 10 is eliminated, by which the developer in the developer circulating portion 11 is put into contact with toner in the toner supplying path 7 and the developer is mixed with the toner by agitation in the developer circulating portion 11. At this point, the developer in the portion distant from the developing sleeve 1 has a weak binding force of the magnetic force applied by the magnet inside the developing sleeve 1 and therefore there is a possibility that the developer diffuses and overflows from the toner supplying path 7 to the toner hopper 6. In the developing apparatus of this embodiment, however, the facing surface 16C of the second regulating member 9C regulates the developer moving direction toward the upstream in the developer conveying direction so that the developer circulating portion 11 does not diffuse to the toner hopper 6. Therefore, the developer circulating portion 11 does not extend toward the toner hopper 6, and thereby the developer is prevented from overflowing into the toner hopper 6.

In this manner, without a partition between the toner supplying path 7 and the toner hopper 6, it is possible to prevent developer from overflowing into the toner hopper 6. Further, there is no possibility that stagnant developer will form a developer bridge on wall surfaces of the developer stagnated portion 10 in the toner supplying path 7. As a result, it is possible to stabilize the toner density and to achieve a more stable and even image density.

The shape of the second regulating member 9C for preventing the diffusion of the developer circulating portion 11 is not limited to the one having the tapered facing surface 16C with the gap to the developing sleeve 1 gradually narrowing from the upstream to the downstream in the developer conveying direction, but any shape can be applied only if it has a developer layer thickness regulating section spaced from the developing sleeve 1 so as to regulate an increase of developer when a layer thickness of the developer is increased due to a rise of a toner density of the developer on the developing sleeve 1 and a circulating direction regulating section for regulating the developer moving direction so that the developer circulating portion 11 does not diffuse to the toner hopper 6 when the developer obstructed by the developer layer thickness regulating section moves upstream in the developer conveying direction and forms the developer circulating portion 11.

In the developing apparatus illustrated in FIG. 10, if the facing surface 16C of the second regulating member 9C is made of magnetic material, a bridge of developer is formed between the facing surface 16C and the developing sleeve 1. When the toner density of the developer on the developing sleeve 1 is decreased by a consumption of toner, a force of obstructing taking toner into the developer is increased by a developer bridge formed between the facing surface 16C and the developing sleeve 1, which causes a possibility that a required amount of toner will not be taken into the developer. If the above-described phenomenon is repeated, an abnormal image having, for example a blank area, may be generated.

Therefore, in this embodiment, the facing surface 16C of the second regulating member 9C is made of non-magnetic material. This prevents a developer bridge from being formed between the facing surface 16C and the developing sleeve 1. Accordingly, when the toner density of the developer is decreased, a required amount of toner can be taken into the developer.

Next, conditions of achieving the above behaviors of the developer and the toner 5 are described below by giving an example.

Figure 11:
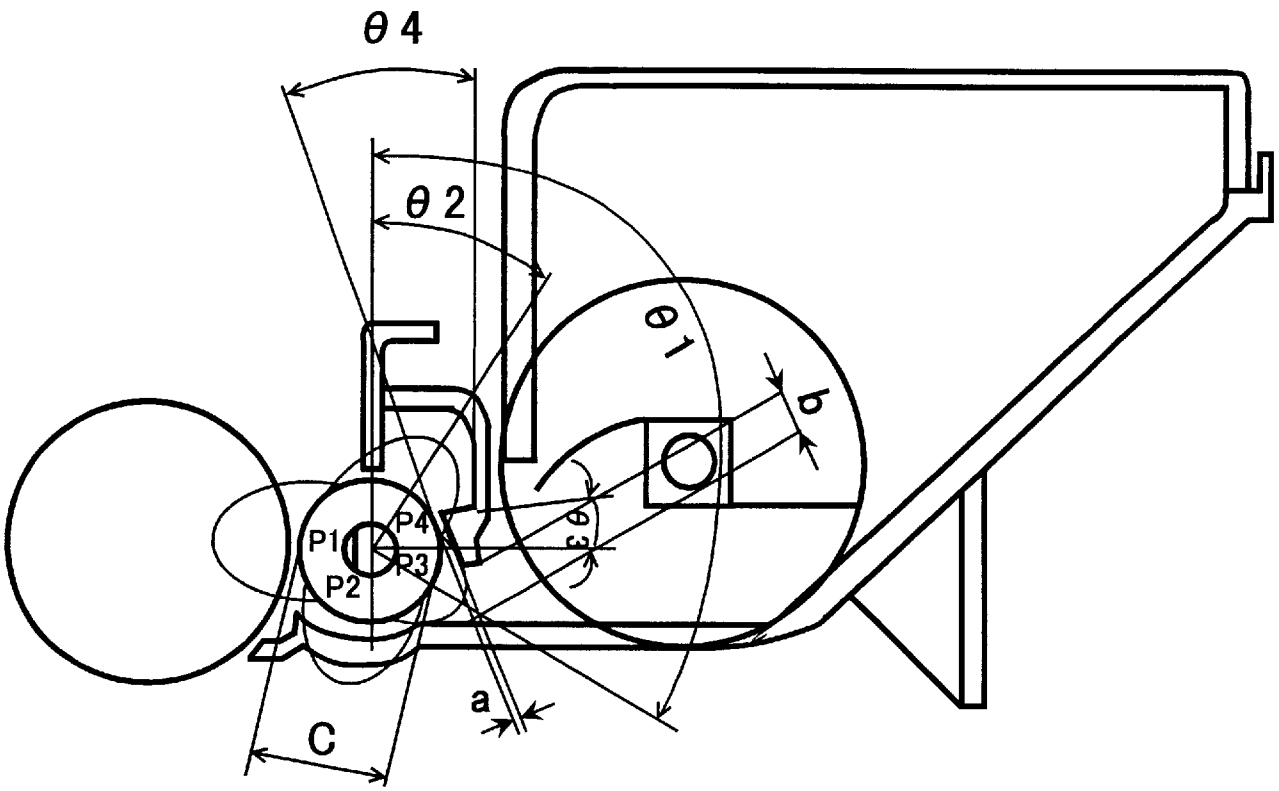
FIG. 11 is a schematic drawing for explaining the configuration of the developing apparatus in FIG. 10.

As illustrated in FIG. 11, regarding magnetic poles of the magnetic field generating device arranged inside the developing sleeve 1, pole P1 is assumed to be the magnetic pole facing the photosensitive drum 13, pole P2 and pole P3 are arranged counterclockwise with the pole P1 as a reference, and pole P4 is arranged in a position opposite to the developer container section 3.

In this condition, in order to form a developer stagnated portion 10 in the contact portion between the toner 5 and the developer when the developer in the developer circulating portion 11 reaches a predetermined density by taking toner into the developer and to suppress a diffusion of the developer circulating portion 11 when the developer circulating portion 11 takes in the developer stagnated portion 10 when the developer toner density is decreased as described above, it is necessary to appropriately set the arrangement and magnetic force of the poles P3 and P4, the shape and position of the second regulating member 9C, the shape and position of the space for circulating developer formed in front of the second regulating member 9C, and the relative positional relationship of the toner supplying path 7.

The following describes an example of appropriate conditions of the relative positional relationship of the above portions of the developing apparatus having the configuration illustrated in FIG. 11, which was obtained on the basis of experimental results.

Angle formed by pole P3 and a vertical: $\theta 1=127$ deg.

Maximum magnetic flux density in a normal direction on a circumferential surface of the developing sleeve 1 of pole P3: 53 mT Angle formed by pole P4 and a vertical: $\theta 2=35$ deg.

Maximum magnetic flux density in a normal direction on a circumferential surface of the developing sleeve 1 of pole P4: 56 mT Angle formed by the second regulating member 9 and a horizontal: $\theta 3=14$ deg.

Angle formed by a facing surface of the second regulating member 9 facing the developing sleeve 1 and a vertical: $\theta 4=24$ deg.

Gap between the second regulating member 9 and a surface of the developing sleeve 1: a=0.6 mm Width of an aperture in the toner supplying path 7: b=5.4 mm Diameter of the developing sleeve 1: c=$\phi$16 mm For the above condition settings, the following developer is used:

Carrier: Magnetite or iron; 40 to 50 $\mu$m

Toner: Amount of magnetic material; 15 to 40 wt %
Amount of silica; 0.5 to 1.0 wt %

Coating ratio of toner to carrier; 50 to 120 wt %

Q/M; 10 to 30 $\mu$c/g

With the above condition settings, the behaviors of developer and toner as described above can be achieved, thereby stabilizing the toner density of the developer.

The above conditions are described just as an example for the developing apparatus according to this embodiment, and the above behaviors of developer and toner can be achieved with other combinations of these conditions.

Next, a description is made below for an arrangement of the magnetic poles opposite to the developer circulating portion 11 and the developing apparatus frame 14.

In the above developing apparatus, when the toner density of the developer is decreased, toner is mixed with developer by agitation in the developer circulating portion 11 and then the toner is taken into a developer layer on the developing sleeve 1 from the contact portion between the developer layer on the developing sleeve 1 and the developer circulating portion 11. At this time, if the developer on the developing sleeve 1 has an ear crack portion, the toner is actively taken into the developer in the ear crack portion. It is assumed that this is because there are a lot of air gaps in the developer which can take in the toner in the ear crack portion in comparison with a portion of the developer where the developer is close together.

In the developing apparatus illustrated in FIG. 10, the pole P3 which is a magnetic pole opposite to the developer circulating portion 11 is completely exposed to the toner supplying path 7, by which the developing apparatus frame 14 does not disturb the ear crack portion of the developer on the developing sleeve 1 which appears in a position corresponding to the peak of the pole P3. Therefore, a stable ear crack portion is formed so as to be in contact with the developer circulating portion 11 on the developing sleeve 1. With this stable ear crack portion, toner in the developer circulating portion 11 can be actively taken into the developer on the developing sleeve 1. Therefore, the toner density is stabilized and an even image is obtained even in forming a halftone image.

Figure 3:
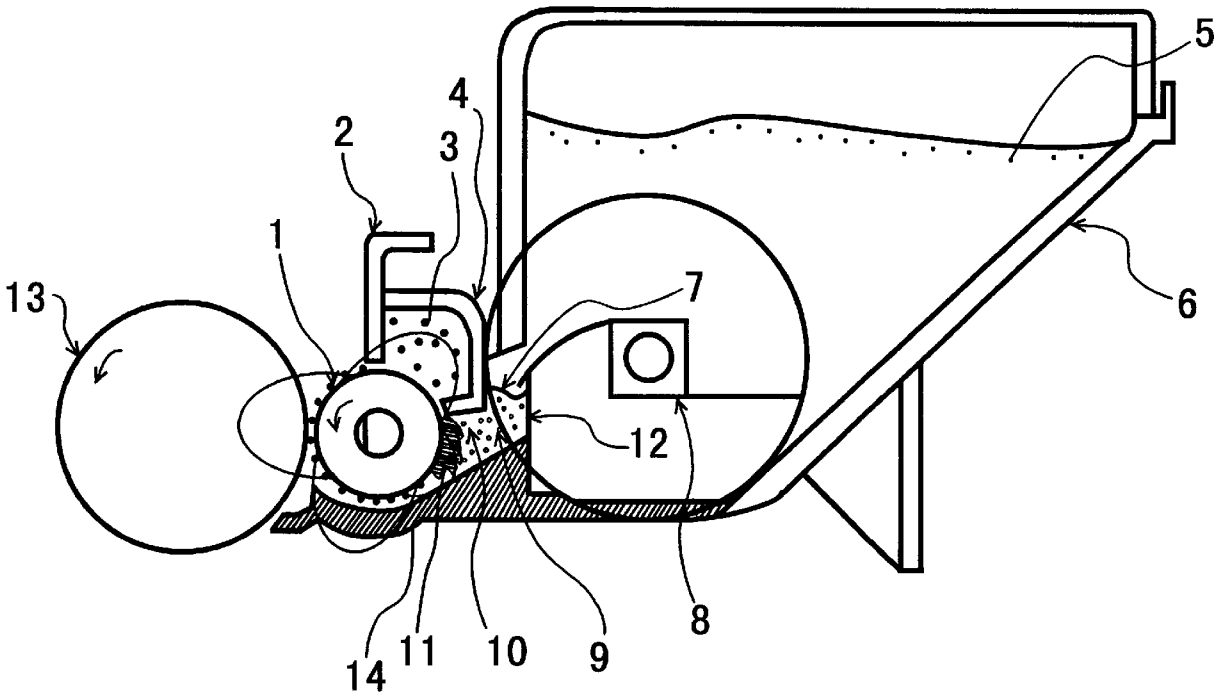
Fig. 3 (PRIOR ART)
FIG. 3 is a schematic drawing illustrating a developing apparatus according to an embodiment of a prior application of the applicant.

As an example for comparison, in a developing apparatus illustrated in FIG. 3, a peak of a magnetic pole opposite to the developer circulating portion 11 of the magnetic field generating device inside the developing sleeve 1 is obstructed by the opposing developing apparatus frame 14 and therefore it is not exposed to the toner supplying path 7. Accordingly, the ear crack portion of developer on the developing sleeve 1, which appears in a position corresponding to the peak of the pole P3, collides with the developing apparatus frame 14 to be disturbed. Therefore, the developer in contact with a circulating space of the developer circulating portion 11 on the developing sleeve 1 does not form a stable ear crack portion and cannot actively take toner in the developer circulating portion 11 from the ear crack portion. Accordingly, the toner density becomes unstable, thereby causing a possibility of generating an uneven image density in forming a halftone image.

Numerous additional modifications and variations of the present invention are possible in light of the above teachings. It is therefore to be understood that within the scope of the appended claims, the present invention may be practiced otherwise than specifically described herein.

This document claims priority and contains subject matter related to Japanese patent applications No. 11-126007, No. 11-125601, No. 11-203408 and No. 12-xxxxx filed in the Japanese Patent Office on May 6, 1999, May 6, 1999, Jul. 16, 1999 and Mar. xx, 2000, respectively, and the entire contents of which are hereby incorporated herein by reference.

What is claimed as new and desired to be secured by Letters Patent of the United States:

1. A developing apparatus, comprising:

a developer bearing member having a magnetic field generating device internally and configured to bear and convey two-component developer including toner and magnetic carrier;

a first regulating member configured to regulate an amount of the developer born and conveyed by the developer bearing member;

a developer container section storing developer scraped off by the first regulating member;

a second regulating member arranged upstream of the first regulating member in a conveying direction of the developer on the developer bearing member; and a toner container section for supplying toner to the developer bearing member, wherein the developing apparatus changes a toner take-in condition of the developer on the developer bearing member by changing a contact condition between the developer and the toner according to a change of a toner density of the developer on the developer bearing member, a surface of the second regulating member facing the developer bearing member has an area sized to unify a layer thickness of the developer on the image bearing member in an axial direction of the developer bearing member, the second regulating member having a base portion with a first width and an end portion with a second width, the second width being larger than the first width, the surface of the second regulating member facing the developer bearing member being provided on the end portion, and the surface of the second regulating member facing the developer bearing member is spaced from a surface of the developer bearing member such that a gap between an end portion of the facing surface of the second regulating member upstream in the developer conveying direction and the surface of the developer bearing member is larger than a gap between a downstream end portion of the facing surface of the second regulating member and the surface of the developer bearing member.

2. A developing apparatus according to claim 1, wherein, the developer container section is formed downstream of the second regulating member in the developer conveying direction, and the facing surface of the second regulating member is extended toward an upstream in the conveying direction of the developer on the developer bearing member.

3. A developing apparatus according to claim 1, wherein the surface of the second regulating member facing the developer bearing member is elongated upstream in the developer conveying direction.

4. A developing apparatus according to claim 1, wherein the surface of the second regulating member facing the developer bearing member is planar.

5. A developing apparatus according to claim 1, wherein a deviation of a magnetic force on the developer bearing member is set such that the layer thickness of the developer passing through the second regulating member is even.

6. A developing apparatus comprising:

a developer bearing member having a magnetic field generating device internally and configured to bear and convey two-component developer including toner and magnetic carrier;

a first regulating member configured to regulate an amount of the developer born and conveyed by the developer bearing member;

a developer container section for containing developer scraped off by the first regulating member;

a second regulating member arranged upstream of the first regulating member in a conveying direction of the developer on the developer bearing member; and a toner container section for supplying toner to the developer bearing member, wherein the developing apparatus changes a toner take-in condition of the developer on the developer bearing member by changing a contact condition between the developer and the toner according to a change of a toner density of the developer on the developer bearing member, the second regulating member is spaced from the developer bearing member so as to regulate an increase of a layer thickness of the developer on the developer bearing member when the layer thickness thereof is increased due to a rise of the toner density of the developer, and a surface of the second regulating member facing the developer bearing member is spaced from a surface of the developer bearing member such that a gap between an end portion of the facing surface of the second regulating member upstream in the developer conveying direction and the surface of the developer bearing member is larger than a gap between a downstream end portion of the facing surface of the second regulating member and the surface of the developer bearing member, the second regulating member having a base portion with a first width and an end portion with a second width, the second width being larger than the first width, the surface of the second regulating member facing the developer bearing member being provided on the end portion.

7. A developing apparatus according to claim 6, wherein a first normal component of a magnetic force, which is applied to developer by the developer bearing member at a downstream end portion of the surface of the second regulating member facing the developer bearing member in the developer conveying direction, is set to be larger than a second normal component of the magnetic force applied to the developer by the developer bearing member at an upstream portion of the surface of the second regulating member in the developer conveying direction.

8. A developing apparatus according to claim 6, wherein a gap between an end-most portion of the surface of the second regulating member upstream in the developer conveying direction and the developer bearing member is set to be larger than a layer thickness of the developer on the developer bearing member.

9. A developing apparatus according to claim 6, wherein the surface of the second regulating member facing the developer bearing member is elongated upstream in the developer conveying direction.

10. A developing apparatus according to claim 6, wherein the surface of the second regulating member facing the developer bearing member is planar.

11. A developing apparatus comprising:

a developer bearing member having a magnetic field generating device internally and configured to bear and convey two-component developer including toner and magnetic carrier;

a first regulating member configured to regulate an amount of the developer born and conveyed by the developer bearing member;

a developer container section for containing developer scraped off by the first regulating member; and a toner container section for supplying toner to the developer bearing member, wherein the developer container section has a second regulating member arranged upstream of the first regulating member in a conveying direction of the developer on the developer bearing member, the second regulating member is spaced from the developer bearing member so as to regulate an increase of a layer thickness of the developer on the developer bearing member when the layer thickness of the developer is increased due to a rise of a toner density of the developer, a surface of the second regulating member facing the developer bearing member is spaced from a surface of the developer bearing member such that a gap between an end portion of the facing surface of the second regulating member upstream in the developer conveying direction and the surface of the developer bearing member is larger than a gap between a downstream end portion of the facing surface of the second regulating member and the surface of the developer bearing member, the second regulating member having a base portion with a first width and an end portion with a second width, the second width being larger than the first width, the surface of the second regulating member facing the developer bearing member being provided on the end portion, a developer circulating portion is formed for circulating the developer obstructed by the second regulating member, and a developer stagnated portion, where the developer stands still when the toner density of the developer is within a predetermined appropriate range, is formed in a toner supplying path connecting the toner container section with the developer circulating portion, such that a condition of taking the toner into the developer is changed by a change of a contact condition between the developer and the toner according to a change of the toner density of the developer on the developer bearing member, and the second regulating member is configured so as to suppress a diffusion of the developer circulating portion.

12. A developing apparatus according to claim 11, wherein, the second regulating member includes a developer layer thickness regulating section, which is spaced from the developer bearing member so as to regulate an increase of a layer thickness of the developer on the developer bearing member when the layer thickness of the developer is increased due to a rise of a toner density of the developer, and a circulating direction regulating section for regulating a motion of the developer so that the developer circulating portion does not diffuse toward the toner container section when the developer obstructed by the developer layer thickness regulating section moves toward an upstream in the developer conveying direction to form the developer circulating portion.

13. A developing apparatus according to claim 12, wherein the circulating direction regulating section of the second regulating member is a surface facing the developer bearing member extending from the developer layer thickness regulating section toward the upstream in the developer conveying direction.

14. A developing apparatus according to claim 11, wherein the surface facing the developer bearing member of the second regulating member is non-magnetic.

15. A developing apparatus according to claim 11, wherein the surface of the second regulating member facing the developer bearing member is elongated upstream in the developer conveying direction.

16. A developing apparatus according to claim 11, wherein the surface of the second regulating member facing the developer bearing member is planar.

17. A developing apparatus, comprising:

a developer bearing member having a magnetic field generating device internally and configured to bear and convey two-component developer including toner and magnetic carrier;

a first regulating member configured to regulate an amount of the developer born and conveyed by the developer bearing member;

a developer container section for containing developer scraped off by the first regulating member; and a toner container section provided adjacent to the developer container section for supplying toner to the developer bearing member, wherein the developer container section has a second regulating member arranged upstream of the first regulating member in the conveying direction of the developer on the developer bearing member, the second regulating member is spaced from the developer bearing member so as to regulate an increase of a layer thickness of the developer on the developer bearing member when the layer thickness of the developer is increased due to a rise of a toner density of the developer, a surface of the second regulating member facing the developer bearing member is spaced from a surface of the developer bearing member such that a gap between an end portion of the facing surface of the second regulating member upstream in the developer conveying direction and the surface of the developer bearing member is larger than a gap between a downstream end portion of the facing surface of the second regulating member and the surface of the developer bearing member, the second regulating member having a base portion with a first width and an end portion with a second width, the second width being larger than the first width, the surface of the second regulating member facing the developer bearing member being provided on the end portion, a developer circulating portion is formed for circulating the developer obstructed by the second regulating member, and a developer stagnated portion, where the developer stands still when the toner density of the developer is within a predetermined range, is formed in a toner supplying path connecting the toner container section with the developer circulating portion, such that a condition of taking the toner into the developer is changed by a change of a contact condition between the developer and the toner according to a change of the toner density of the developer on the developer bearing member, and a developing apparatus frame is configured so as not to disturb an ear crack portion of the developer which is formed on the developer bearing member by a magnetic pole opposite to the developer circulating portion.

18. A developing apparatus according to claim 17, wherein the surface of the second regulating member facing the developer bearing member is elongated upstream in the developer conveying direction.

19. A developing apparatus according to claim 17, wherein the surface of the second regulating member facing the developer bearing member is planar.

20. An image forming apparatus, comprising:

an image bearing member for bearing a latent image; and a developing apparatus for developing the latent image, the developing apparatus including;

a developer bearing member having a magnetic field generating device internally and configured to bear and convey two-component developer including toner and magnetic carrier;

a first regulating member configured to regulate an amount of the developer born and conveyed by the developer bearing member;

a developer container section storing developer scraped off by the first regulating member;

a second regulating member arranged upstream of the first regulating member in a conveying direction of the developer on the developer bearing member; and a toner container section for supplying toner to the developer bearing member, wherein the developing apparatus changes a toner take-in condition of the developer on the developer bearing member by changing a contact condition between the developer and the toner according to a change of a toner density of the developer on the developer bearing member, a surface of the second regulating member facing the developer bearing member has an area sized to unify a layer thickness of the developer on the image bearing member in an axial direction of the developer bearing member, the second regulating member having a base portion with a first width and an end portion with a second width, the second width being larger than the first width, the surface of the second regulating member facing the developer bearing member being provided on the end portion, and the surface of the second regulating member facing the developer bearing member is spaced from a surface of the developer bearing member such that a gap between an end portion of the facing surface of the second regulating member upstream in the developer conveying direction and the surface of the developer bearing member is larger than a gap between a downstream end portion of the facing surface of the second regulating member and the surface of the developer bearing member.

21. An image forming apparatus according to claim 20, wherein, the developer container section is formed downstream of the second regulating member in the developer conveying direction, and the facing surface of the second regulating member is extended toward an upstream in the conveying direction of the developer on the developer bearing member.

22. An image forming apparatus according to claim 20, wherein a deviation of a magnetic force on the developer bearing member is set such that the layer thickness of the developer passing through the second regulating member is even.

23. An image forming apparatus according to claim 20, wherein the surface of the second regulating member facing the developer bearing member is elongated upstream in the developer conveying direction.

24. An image forming apparatus according to claim 20, wherein the surface of the second regulating member facing the developer bearing member is planar.

25. An image forming apparatus, comprising:

an image bearing member for bearing a latent image; and a developing apparatus for developing the latent image, the developing apparatus including:

a developer bearing member having a magnetic field generating device internally and configured to bear and convey two-component developer including toner and magnetic carrier;

a first regulating member configured to regulate an amount of the developer born and conveyed by the developer bearing member;

a developer container section for containing developer scraped off by the first regulating member;

a second regulating member arranged upstream of the first regulating member in a conveying direction of the developer on the developer bearing member; and a toner container section for supplying toner to the developer bearing member, wherein the developing apparatus changes a toner take-in condition of the developer on the developer bearing member by changing a contact condition between the developer and the toner according to a change of a toner density of the developer on the developer bearing member, the second regulating member is spaced from the developer bearing member so as to regulate an increase of a layer thickness of the developer on the developer bearing member when the layer thickness thereof is increased due to a rise of the toner density of the developer, and a surface of the second regulating member facing the developer bearing member is spaced from a surface of the developer bearing member such that a gap between an end portion of the facing surface of the second regulating member upstream in the developer conveying direction and the surface of the developer bearing member is larger than a gap between a downstream end portion of the facing surface of the second regulating member and the surface of the developer bearing member, the second regulating member having a base portion with a first width and an end portion with a second width, the second width being larger than the first width, the surface of the second regulating member facing the developer bearing member being provided on the end portion.

26. An image forming apparatus according to claim 25, wherein a first normal component of a magnetic force, which is applied to the developer by the developer bearing member at a downstream end portion of the surface of the second regulating member facing the developer bearing member in the developer conveying direction, is set to be larger than a second normal component of the magnetic force applied to the developer by the developer bearing member at an upstream portion of the surface of the second regulating member in the developer conveying direction.

27. An image forming apparatus according to claim 25, wherein a gap between an end-most portion of the surface of the second regulating member upstream in the developer conveying direction and the developer bearing member is set to be larger than the layer thickness of the developer on the developer bearing member.

28. An image forming apparatus according to claim 25, wherein the surface of the second regulating member facing the developer bearing member is elongated upstream in the developer conveying direction.

29. An image forming apparatus according to claim 25, wherein the surface of the second regulating member facing the developer bearing member is planar.

30. An image forming apparatus, comprising:

an image bearing member for bearing a latent image;

a developing apparatus for developing the latent image, the developing apparatus including;

a developer bearing member having a magnetic field generating device internally and configured to bear and convey two-component developer including toner and magnetic carrier;

a first regulating member configured to regulate an amount of the developer born and conveyed by the developer bearing member;

a developer container section for containing the developer scraped off by the first regulating member; and a toner container section for supplying toner to the developer bearing member, wherein the developer container section has a second regulating member arranged upstream of the first regulating member in a conveying direction of the developer on the developer bearing member, the second regulating member is spaced from the developer bearing member so as to regulate an increase of a layer thickness of the developer on the developer bearing member when the layer thickness of the developer is increased due to a rise of a toner density of the developer, a surface of the second regulating member facing the developer bearing member is spaced from a surface of the developer bearing member such that a gap between an end portion of the facing surface of the second regulating member upstream in the developer conveying direction and the surface of the developer bearing member is larger than a gap between a downstream end portion of the facing surface of the second regulating member and the surface of the developer bearing member, the second regulating member having a base portion with a first width and an end portion with a second width, the second width being larger than the first width, the surface of the second regulating member facing the developer bearing member being provided on the end portion, a developer circulating portion is formed for circulating developer obstructed by the second regulating member, and a developer stagnated portion, where the developer stands still when a toner density of the developer is within a predetermined appropriate range, is formed in a toner supplying path connecting the toner container section with the developer circulating portion, such that a condition of taking the toner into the developer is changed by a change of a contact condition between the developer and the toner according to a change of the toner density of the developer on the developer bearing member, and the second regulating member is configured so as to suppress a diffusion of the developer circulating portion.

31. An image forming apparatus according to claim 30, wherein, the second regulating member includes a developer layer thickness regulating section, which is spaced from the developer bearing member so as to regulate an increase of a layer thickness of the developer on the developer bearing member when the layer thickness of the developer is increased due to a rise of a toner density of the developer, and a circulating direction regulating section for regulating a motion of the developer so that the developer circulating section does not diffuse toward the toner container section when the developer obstructed by the developer layer thickness regulating section moves toward an upstream in the developer conveying direction to form the developer circulating portion.

32. An image forming apparatus according to claim 31, wherein the circulating direction regulating section of the second regulating member is a surface facing the developer bearing member extending from the developer layer thickness regulating section toward the upstream in the developer conveying direction.

33. An image forming apparatus according to claim 30, wherein the surface facing the developer bearing member of the second regulating member is non-magnetic.

34. An image forming apparatus according to claim 30, wherein the surface of the second regulating member facing the developer bearing member is elongated upstream in the developer conveying direction.

35. An image forming apparatus according to claim 30, wherein the surface of the second regulating member facing the developer bearing member is planar.

36. An image forming apparatus, comprising:

an image bearing member for bearing a latent image; and a developing apparatus for developing the latent image, the developing apparatus including;

a developer bearing member having a magnetic field generating device internally and configured to bear and convey two-component developer including toner and magnetic carrier;

a first regulating member configured to regulate an amount of the developer born and conveyed by the developer bearing member;

a developer container section for containing the developer scraped off by the first regulating member; and a toner container section provided adjacent to the developer container section for supplying toner to the developer bearing member, wherein the developer container section has a second regulating member arranged upstream of the first regulating member in a conveying direction of the developer on the developer bearing member, the second regulating member is spaced from the developer bearing member so as to regulate an increase of a layer thickness of the developer on the developer bearing member when the layer thickness of the developer is increased due to a rise of a toner density of the developer, a surface of the second regulating member facing the developer bearing member is spaced from a surface of the developer bearing member such that a gap between an end portion of the facing surface of the second regulating member upstream in the developer conveying direction and the surface of the developer bearing member is larger than a gap between a downstream end portion of the facing surface of the second regulating member and the surface of the developer bearing member, the second regulating member having a base portion with a first width and an end portion with a second width, the second width being larger than the first width, the surface of the second regulating member facing the developer bearing member being provided on the end portion, a developer circulating portion is formed for circulating the developer obstructed by the second regulating member, and a developer stagnated portion, where the developer stands still when a toner density of the developer is within a predetermined appropriate range, is formed in a toner supplying path connecting the toner container section with the developer circulating portion, such that a condition of taking the toner into the developer is changed by a change of a contact condition between the developer and the toner according to a change of the toner density of the developer on the developer bearing member, and a developing apparatus frame is configured so as not to disturb an ear crack portion of the developer which is formed on the developer bearing member by a magnetic pole opposite to the developer circulating portion.

37. An image forming apparatus according to claim 36, wherein the surface of the second regulating member facing the developer bearing member is elongated upstream in the developer conveying direction.

38. An image forming apparatus according to claim 36, wherein the surface of the second regulating member facing the developer bearing member is planar.

* * * * *